US006334666B1

(12) United States Patent
Inui et al.

(10) Patent No.: US 6,334,666 B1
(45) Date of Patent: Jan. 1, 2002

(54) INK-JET RECORDING HEAD, INK-JET APPARATUS, INK-JET RECORDING METHOD, RECORDED PRODUCTS OBTAINED BY EMPLOYING THE METHOD OR APPARATUS

(75) Inventors: Toshiharu Inui; Hiromitsu Hirabayashi, both of Yokohama; Jiro Moriyama, Kawasaki; Hiroshi Tajika, Yokohama; Yutaka Kurabayashi, Tokorozawa; Hitoshi Sugimoto, Yokohama; Kiichiro Takahashi; Fumihiro Gotoh, both of Kawasaki; Masaya Uetsuki, Yokohama; Masao Kato, Yokohama; Minako Kato, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/635,916

(22) Filed: Aug. 10, 2000

Related U.S. Application Data

(62) Division of application No. 08/512,791, filed on Aug. 10, 1995, now Pat. No. 6,123,411.

(30) Foreign Application Priority Data

| | | |
|---|---|---|
| Aug. 10, 1994 | (JP) | 6-188196 |
| Feb. 13, 1995 | (JP) | 7-023575 |
| Aug. 8, 1995 | (JP) | 7-202632 |

(51) Int. Cl.[7] ..... B41J 2/21; B41J 2/17
(52) U.S. Cl. ..... 347/43; 347/95
(58) Field of Search ..... 347/43, 100, 96, 347/98, 19, 95

(56) References Cited

U.S. PATENT DOCUMENTS

| | | | | |
|---|---|---|---|---|
| 4,313,124 | A | 1/1982 | Hara | |
| 4,345,262 | A | 8/1982 | Shirato et al. | |
| 4,459,600 | A | 7/1984 | Sato et al. | |
| 4,463,359 | A | 7/1984 | Ayata et al. | |
| 4,558,333 | A | 12/1985 | Sugitani et al. | |
| 4,608,577 | A | 8/1986 | Hori | |
| 4,630,076 | A | 12/1986 | Yoshimura | 347/15 |
| 4,723,129 | A | 2/1988 | Endo et al. | |
| 4,740,796 | A | 4/1988 | Endo et al. | |
| 5,635,969 | A * | 6/1997 | Allen | 347/96 |

FOREIGN PATENT DOCUMENTS

| | | |
|---|---|---|
| JP | 54-56847 | 5/1979 |
| JP | 56-84992 | 7/1981 |
| JP | 59-123670 | 7/1984 |
| JP | 59-138461 | 8/1984 |
| JP | 60-71260 | 4/1985 |

* cited by examiner

*Primary Examiner*—Thinh Nguyen
(74) *Attorney, Agent, or Firm*—Fitzpatrick, Cella, Harper & Scinto

(57) ABSTRACT

An ink-jet recording apparatus ejects droplets of a recording-improvement liquid on a boundary line between two different color portions of an image by using an ink-jet recording head. The ink-jet recording head comprises a group of nozzles for ejecting the recording-improvement liquid which is responsible for precipitating or condensing a coloring substance in the ink. Accordingly, a high-quality image that comprises black-color portion with a high image density without causing any feathering and multiple-color portions without a spread of ink can be obtained.

11 Claims, 23 Drawing Sheets

INK-JET RECORDING HEAD, INK-JET APPARATUS, INK-JET RECORDING METHOD, RECORDED PRODUCTS OBTAINED BY EMPLOYING THE METHOD OR APPARATUS

This application is a division of Ser. No. 08/512,791 filed Aug. 10, 1995 now U.S. Pat. No. 6,123,411.

BACKGROUND OF THE INVENTION

1. Field of the Invention

This invention relates to an ink-jet recording method, an ink-jet recording apparatus using such method, an information-processing apparatus using such apparatus as an output device for obtaining a high-quality image on a recording medium, and a recorded product produced by the above apparatuses. Especially, the ink-jet recording method has the step of ejecting an aqueous liquid for making a color material insoluble or in an aggregated form. The term "recording" includes the meaning of printing, image-forming, dyeing, and all kinds of a supply of ink or the like on a recording medium such as cloth, textile, paper, OHP sheet, and so on. Therefore, the present invention can be adaptable not only to a specific field (i.e., information processing) but also to a wide range of the technical fields that use the recording medium.

2. Description of the Related Art

Among conventional recording apparatuses, an ink-jet type recording apparatus adapted to execute recording on a recording medium (sheet of recording paper, cloth, sheet of plastic material or the like) by ejecting ink from a plurality of ejecting ports disposed on the recording elements while generating few noisy sound without any impact induced by each recording operation makes it possible to perform each recording operation not only at a high density but also at a high speed. For this reason, a number of ink-jet type recording apparatuses are utilized for an information processing apparatus on the commercial basis.

In practice, the ink-jet recording apparatus is used as a printer located at an output terminal of an information processing apparatus, e.g., a copying machine, a facsimile, a computer, a word processor, a work station or the like or as a handy or portable printer to be equipped in operative association with a personal computer, a host computer, an optical disc unit, a video unit or the like.

A conventional recording apparatus as mentioned above includes a carriage for mounting a recording means (recording head) and ink-supplying means (ink tank) thereon , a conveying means for conveying a recording medium, a driving means for reciprocally displacing a recording head in the direction at a right angle relative to the direction of conveyance of a recording medium, and a controlling means for controlling the ejection of ink from the recording head, the conveyance of a recording medium and the reciprocal displacement of the recording head with the aid of driving means.

The recording head adapted to eject ink droplets from a plurality of ejection ports thereof is serially scanned in the direction at a right angle relative to the direction of conveyance of the recording medium (i.e., in the main scanning direction), and subsequently, the recording medium is intermittently conveyed at a quantity of displacement thereof equal to the recorded width of the recording medium while no recording operation is performed. With this recording method, recording is executed in response to a recording signal by ejecting ink onto the recording medium. For this reason, the foregoing recording method is widely used as a quiet recording apparatus capable of being practiced at an inexpensive running cost. When a large number of nozzles each adapted to eject ink therefrom is formed on the recording head along a straight line extending at a right angle relative to the direction of displacement of the recording head relative to the recording medium, recording can be executed by a quantity of width corresponding to the number of nozzles by simultaneously scanning the recording head on the recording medium. This makes it possible to perform a recording operation at a higher speed.

It should be added that a recording apparatus capable of forming a full color image has been put in practical use. The apparatus is able to mount a recording head adapted to eject three or four kinds on inks, i.e., primary colors (yellow (Y), magenta (M), and cyan (C)), or with black (Bk), and ink tanks of these inks.

In the conventional ink-jet recording method and apparatus, however, it is difficult to obtain an image with an extremely high quality enough to request to the user's demand because of the following reasons. That is, the conventional method and apparatus do not prevent (i) a spread of ink on the boundary areas among black (Bk), yellow (Y), magenta (M), and cyan (C); and (ii) a formation of an black image at high-density without causing any feathering, all at once.

For obtaining a multiple-color image on a sheet of general paper, in general, a quick-drying ink that soaks into the general paper at high speed has been used. Thus it is able to prevent a spread of the ink on the boundary area between the colors that constitute the image.

In the case of using the quick-drying ink, however, a black-image portion tends to become of a low concentration while color image portions except the black tend to become of a low coloring.

Furthermore, in the case of recording a line drawing such as characters, the ink tends to spread along fibers of paper (i.e., so-called feathering). Especially, the feathering generated in the character recorded by the black ink is easily to come into prominence without a sharpness. As a result, the image having an extremely low qualities on the whole can be obtained.

By using the ink of comparatively low rate of permeating into the general paper, in general, the number of the ink droplets to be placed at one point should be increased to some degree for obtaining a high-quality image without causing a conspicuous feathering. In this case, however, the quality of a recording image can be remarkably damaged.

For eliminating these shortcomings, a recording apparatus having a heating means that accelerates ink-drying has been practically used for obtaining a multiple-color image that comes out well without any spread of ink between the colors. However, this kind of the way to solve the problems require a large-sized apparatus and its costly manufacturing process.

In this way, therefore, the problems to be solved are: providing a high-quality image that comprises black-color portion with a high image density; and preventing any feathering and spread of the ink between the inks such as of black and other colors, which are directly-opposed ideas.

To solve the problems, a document of Japanese Patent Application Laying-Open No. 146355/1991 offers a recording method includes the step of recording an image except a predetermined area along a boundary line between a black image portion and another color image portion. In this method, therefore, the data to be used for recording the image is changed.

In a document of Japanese Patent Application Laying-Open No. 158049/1992, a recording method includes the step of switching two recording heads. That is one is for recording a plurality of colors and the other is for recording characters in accordance with the image to be recorded. In this case, however, these heads form black image portions in different ways, respectively. When the black image portions formed by different heads are mixed with or adjacent to each other, there is the state or quality of being incompatible.

Furthermore, it may be possible to prevent a spread of ink on a boundary between a black image portion and another color image portion by forming a black area along the boundary by placing color inks one upon another. In principle, that is, a black color can be expressed by placing three principle colors (Y, M, and C) on top of one another (i.e., color-blending). In this case, however, a coloring of the black thus formed is worse than that of the pure black.

Moreover, Japanese Patent Application Laying-Open No. 84992/1981 and Japanese Patent Application Laying-Open No. 63185/1989 disclose the techniques of using an aqueous liquid that makes a dyestuff of ink insoluble.

In Japanese Patent Application Laying-Open No. 84992/1981, a large number of sheets of recording paper is mass-manufactured and then a surface of each sheet thereof is covered with a material that fixes a dyestuff thereon, prior to record an image. In this case, however, a specific type of the recording paper must be used and also a storage device must be required for preserving a large number of sheets of the recording-paper mass-manufactured. In addition, therefore, additional devices must be equipped in the recording apparatus or provided as its peripheral devices, resulting in a costly large-sized apparatus. It is noted that, furthermore, there is difficulty to apply the above material on the recording medium so as to form a layer thereof with a predetermined thickness.

Another document, Japanese Patent Application Laying-Open No. 63185/1989 discloses a recording method including the step of placing a clear aqueous liquid (clear ink) that makes a dyestuff insoluble on a recording medium by ejecting the clear ink from an ink-jet recording head. According to that process, a diameter of each dot to be formed by the clear ink is larger than that of ink used for image formation, so that a desired image quality can be attained regardless of slightly slipping out of predetermined positions. In the above process, furthermore, an amount of the clear ink to be placed is larger than that of the color ink to be placed, so that the time required for drying the ink becomes longer and a resulting image can be extremely indistinct.

As described above, each of the conventional methods disclosed in the above documents disclosed in the above documents have some disadvantages. However, means for making a dyestuff of ink insoluble has a possibility of preventing a spread of ink on a boundary between different colors.

SUMMARY OF THE INVENTION

The first object of the present invention is to provide an ink-jet recording method and ink-jet recording apparatus using such method, in which an aqueous liquid is used for making a dyestuff in ink insoluble and realize a low running cost by keeping the consumption of that liquid below a level as low as possible, for providing a high-density image having an excellent water resisting property compared with that of the conventional one regardless of using general paper, and also for providing a coloring image without causing a spread of ink on a boundary between the colors when they are applied in a multiple-color image formation.

The second object of the present invention is to provide an ink-jet recording method and ink-jet recording apparatus using such method for a multiple-color image formation, by which a high-quality and density image is obtained without causing a spread of ink on a boundary between a black image portion and another color image portion and also without causing any feathering regardless of the image including the black image portion and the color image portion.

In a first aspect of the present invention, there is provided an ink-jet recording apparatus for recording an image on a recording medium, comprising:

a transport means for mounting a recording means that ejects single-color ink or multiple-color ink for recording a multiple-color image and a means for ejecting recording-improvement liquid, and for reciprocating the recording means and the means for ejecting the recording-improvement liquid in a main-scanning direction;

a control means for controlling at least driving of the recording means and a driving of the means for ejecting the recording-improvement liquid; and a feeding means for feeding the recording medium in a sub-scanning direction perpendicular to the main-scanning direction, when the image has a boundary area having a boundary line between two different color regions and/or a peripheral region thereof consisting of a predetermined number of dots around the boundary line, the control means controls the movement of the means for ejecting the recording-improvement liquid so as to eject the recording-improvement liquid on an area of the recording medium corresponding to the boundary line and/or the peripheral region thereof.

In a second aspect of the present invention, there is provided a recorded material having a recording medium and an image formed on the recording medium, where the image has a boundary area having a boundary line between two different color regions and/or a peripheral region thereof consisting of a predetermined number of dots around the boundary line, and the boundary area having a portion where a recording-improvement liquid is ejected.

In a third aspect of the present invention, there is provided an information-processing apparatus using an ink-jet recording apparatus as an output means, wherein the ink-jet recording apparatus is for recording an image on a recording medium and comprises:

a transport means for mounting a recording means that ejects single-color ink or multiple-color ink for recording a multiple-color image and a means for ejecting recording-improvement liquid, and for reciprocating the recording means and the means for ejecting the recording-improvement liquid in a main-scanning direction;

a control means for controlling at least a driving of the recording means and a driving of the means for ejecting the recording-improvement liquid; and a feeding means for feeding the recording medium in a sub-scanning direction perpendicular to the main-scanning direction, wherein when the image has a boundary area having a boundary line between two different color regions and/or a peripheral region thereof consisting of a predetermined number of dots around the boundary line, the control means controls the movement of the means for ejecting the recording-improvement liquid so as to eject the recording-improvement liquid on an area of the recording medium corresponding to the boundary line and/or the peripheral region thereof.

In a fourth aspect of the present invention, there is provided an ink-jet recording method comprising the steps of:

recording an image on a recording medium by using a recording means that ejects single-color ink or multiple-color ink for performing a full-color recording, where the image has a boundary area having a boundary line between two different color regions and/or a peripheral region thereof consisting of a predetermined number of dots around the boundary line;

ejecting a recording-improvement liquid on the boundary area having the boundary line between two different color regions and/or the peripheral region thereof by using a means for ejecting the recording-improvement liquid;

transporting the recording means and the means for ejecting the recording-improvement liquid in the main-scanning direction;

controlling at least a driving of the recording means and a driving of the means for ejecting the recording-improvement liquid; and feeding the recording medium in a sub-scanning direction perpendicular to the main-scanning direction.

In a fifth aspect of the present invention, there is provided an ink-jet recording head comprising:

a first group of nozzles for ejecting ink of a first color;

a second group of nozzles for ejecting ink of at least one color as a second color, which is different from the first color; and a third group of nozzles for ejecting the recording-improvement liquid on an area of a recording medium corresponding to a boundary line between two different color regions and/or the peripheral region thereof, where a multiple-color image is formed by ejecting single-color ink or multiple-color ink on the recording medium and recording-improvement liquid.

In a sixth aspect of the present invention, there is provided the ink-jet recording head as claimed in claim 40, wherein the third group of nozzles is arranged between the first group of nozzles and the second group of nozzles, where the first group of nozzles, the second group of nozzles, and the third group of nozzles are lined in a main-scanning direction.

In a seventh aspect of the present invention, there is provided an ink-jet recording apparatus for recording an image on a recording medium, comprising:

a transport means for mounting a recording means that ejects single-color ink or multiple-color ink for recording a multiple-color image and a means for ejecting recording-improvement liquid, and for reciprocating the recording means and the means for ejecting the recording-improvement liquid in a main-scanning direction;

a control means for controlling at least a driving of the recording means and a driving of the means for ejecting the recording-improvement liquid; and a feeding means for feeding the recording medium in a sub-scanning direction perpendicular to the main-scanning direction, where the control means controls the ejecting means for ejecting the recording-improvement liquid on the recording medium to form the image with a predetermined pattern of:

a portion on which the recording-improvement liquid and the ink are ejected; and a portion on which only the ink is ejected.

In an eighth aspect of the present invention, there is provided an ink-jet recording method, comprising the steps of:

recording an image on a recording medium by using a recording means that ejects single-color ink or multiple-color ink for performing a-full-color recording;

ejecting a recording-improvement liquid on the recording medium by using a means for ejecting the recording-improvement liquid;

transporting the recording means and the means for ejecting the recording-improvement liquid in the main-scanning direction;

feeding the recording medium in a sub-scanning direction perpendicular to the main-scanning direction; and controlling at least a driving of the recording means and a driving of the means for ejecting the recording-improvement liquid to form the image with a predetermined pattern of:

a portion on which the recording-improvement liquid and the ink are ejected; and a portion on which only the ink is ejected.

In a ninth aspect of the present invention, there is provided an information-processing apparatus using an ink-jet recording apparatus as an output means, where the ink-jet recording apparatus is for recording an image on a recording medium and comprises:

a transport means for mounting a recording means that ejects single-color ink or multiple-color ink for recording a multiple-color image and a means for ejecting recording-improvement liquid, and for reciprocating the recording means and the means for ejecting the recording-improvement liquid in a main-scanning direction;

a control means for controlling at least a driving of the recording means and a driving of the means for ejecting the recording-improvement liquid: and a feeding means for feeding the recording medium in a sub-scanning direction perpendicular to the main-scanning direction, where the control means controls the ejecting means for ejecting the recording-improvement liquid on the recording medium to form the image with a predetermined pattern of:

a portion on which the recording-improvement liquid and the ink are ejected; and a portion on which only the ink is ejected.

In a tenth aspect of the present invention, there is provided a recorded material having a recording medium and an image formed on the recording medium, where the image comprises:

a portion on which the recording-improvement liquid and the ink are ejected; and a portion on which only the ink is ejected.

The above and other objects, effects, features, and advantages of the present invention will become more apparent from the following description of embodiments thereof taken in conjunction with the accompanying drawings.

BRIEF DESCRIPTION OF THE DRAWINGS

FIG. 1A is a dot pattern of the image formed on a recording medium by ejecting ink droplets from the recording head; FIGS. 1A–1F show examples of patterns of dots that receive droplets of a recording-improvement liquid on the recording medium, prior to the image formation of FIG. 1A;

FIG. 2A shows the image consisting of a black image portion and a yellow image portion which are adjacent to each other, and FIG. 2B shows a pattern of placing droplets of the recording-improvement liquid with respect to the image, and FIG. 2C shows an example of placing the droplets of the recording-improvement liquid on only a boundary area between the above image portions;

FIG. 8A shows the image consisting of a black image portion and a yellow image portion which are adjacent to each other, and FIGS. 8B–8D show patterns of placing droplets of the recording-improvement liquid with respect to the image;

FIG. 14A shows the image consisting of a black image portion and a color image portion which are adjacent to each other, and FIG. 14B shows a pattern of placing droplets of the recording-improvement liquid with respect to the image;

FIG. 23A shows the image consisting of a black image portion and a yellow image portion which are adjacent to each other, and FIGS. 23B–23F show different patterns of placing droplets of the recording-improvement liquid with respect to the image;

FIG. 25A shows the image consisting of a color A image portion and a color B image portion which are adjacent to each other, and FIGS. 25B–25E show different patterns of placing droplets of the recording-improvement liquid with respect to the image;

DETAILED DESCRIPTION OF PREFERRED EMBODIMENTS

Hereinafter we will explain preferred embodiments of the present invention with reference to drawings.

First of all, an ink-jet recording method and an ink-jet recording apparatus using such method will be explained in detail. By the process of multiple-color recording in accordance with the present invention, a multiple-color image can be obtained with its excellent cost effectiveness. The obtained image shows excellent coloring and high image-density without causing a spread of color inks because of being treated with an aqueous liquid that makes a dyestuff insoluble in the ink at a much lower expenditure compared with that of the conventional one. Irrespective of forming the image on a sheet of ordinary paper, therefore, a extremely higher resistance to water can be attained.

Embodiment 1

In accordance with a first preferred embodiment of the present invention, an ink-jet recording method comprises two steps. That is, the fist step is of ejecting a colorless or light-color aqueous liquid on a recording medium in accordance with an input image data. The aqueous liquid contains a compound responsible for making a dyestuff of an ink liquid insoluble in water. Hereinafter, therefore, the aqueous liquid will be also referred as a recording-improvement liquid. On the other hand, the second step is of ejecting a black ink on the recording medium in accordance with the above image data.

Figure 1A:
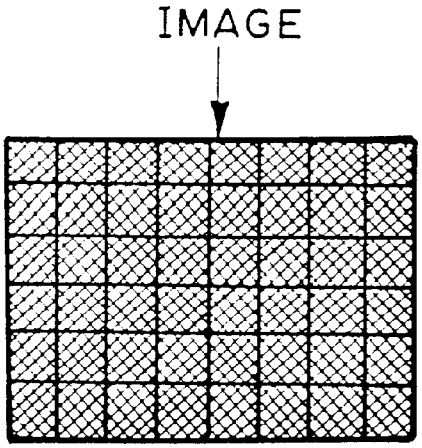
FIGS. 1A–1F are schematic representations of a monochromatic image consisting of a plurality of dots as in the regular formation thereof into columns and rows, where
Figure 1B:
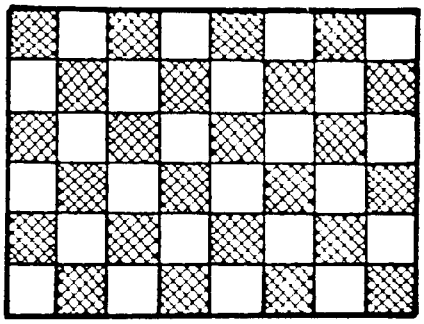
Figure 1C:
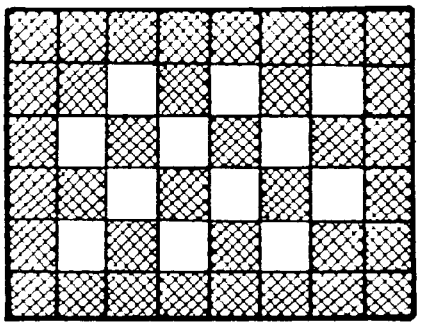

FIGS. 1A–1F are schematic representations of a monochromatic image consisting of a plurality of dots as in the regular formation thereof into columns and rows (i.e., a matrix of 6×8 dots). In the figure, each square stands for each dot of the image. In the figure, also, FIG. 1A is a dot pattern of the image formed on a recording medium by ejecting ink droplets from the recording head. In this case, all dots required for the complete image are recorded without thinning down any of them. FIGS. 1B–1F show examples of dot patterns formed by ejecting droplets of the recording-improvement liquid on the recording medium, prior to the image formation of FIG. 1A. In the dot patterns of FIGS. 1B–1F, each black square stands for a portion where the recording-improvement liquid is applied and corresponds to one dot of the image. In the case of FIG. 1B, that is, a predetermined number of the black squares are thinned down so as to form a checkered pattern of the areas where droplets of the recording-improvement liquid are placed. In the case of FIG. 1C, there two different portions that receive the recording-improvement liquid. That is, a peripheral portion of the image is covered with the recording-improvement liquid. On the other hand, a middle portion of the image receives a plurality of droplets of the recording-improvement liquid so as to form a checkered pattern thereof by thinning down 50% of the black squares to be covered with that liquid. It is noted that one of the above dot patterns of FIGS. 1A–1D is optionally selected in accordance with the image quality to be required, a type of ink to be used, a type of recording medium, and so on. In the case of FIG. 1C, for example, the amount of the liquid used is greater than that of FIG. 1B because a whole of the peripheral portion of the image receives the recording-improvement liquid. In this case, however, the peripheral portion can be distinctly obtained by using the ink that permeates in the medium at comparatively high rate.

By limiting the amount of the data for ejecting the recording-improvement liquid with respect to the image data to be required for recording all dots of the image, it become possible to decrease the amount of the recording-improvement liquid to be used without losing the effects of the recording-improvement liquid.

Figure 1D:
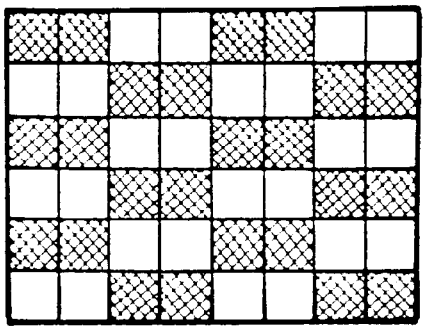
Figure 1E:
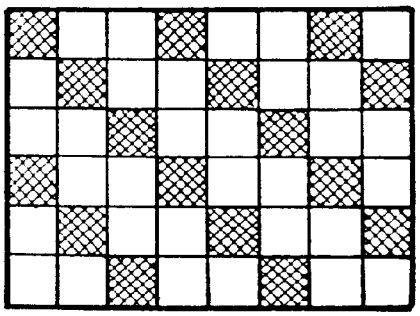
Figure 1F:
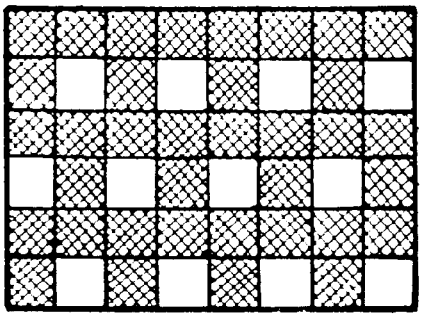

In these figures, the examples shown in FIG. 1B and FIG. 1D set up the thinning-down rate of 50% but not limited to. It is also possible to set up another range in accordance with the image to be obtained, the size of an ejected droplet of the recording-improving liquid, and physical- or chemical-properties of the recording-improvement liquid, ink, recording medium, or the like. For obtaining a sufficient property of water-resistant, it is preferable to set up the thinning-down rate of less than 50%. When the amount of ejecting the recording-improvement liquid is comparatively higher or when the recording process uses the recording medium on-which the ink runs easily, there is no problem even though thin out more than 50% as shown in FIG. 1E. If making an opposite case, it is good to lower the ratio of thinning down as shown in FIG. 1F.

Furthermore, the way of thinning down is not limited to use the checkered pattern for every one dot. It is also possible to perform the thinning-down every two dots as shown in FIG. 1D, or randomly.

In accordance with the present invention, a pattern of a thinning down is not restricted to one of the above patterns of FIGS. 1B–1F. It is also possible to select one of the other patterns as responding necessity.

Embodiment 2

An ink-jet recording method of the second preferred embodiment of the present invention comprises two steps. The fist step is of ejecting a recording-improvement liquid on a recording medium in accordance with an input image data. The second step is of ejecting color inks on the recording medium in accordance with the input image data for recording a multiple-color image. As a preferred embodiment of the present invention, with reference to FIG. 2, we are now explaining the case of recording a black image portion and a yellow image portion which are adjacent to each other. In the figure, each image portion is formed as a matrix of 5 by 4 dots.

Figure 2A:
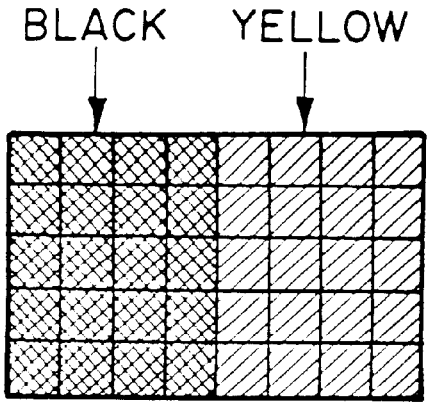
FIGS. 2A–2C are schematic representations of an image for illustrating an ink-jet recording method in accordance with the present invention, where
Figure 2B:
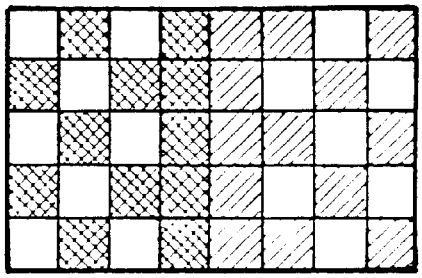
Figure 2C:
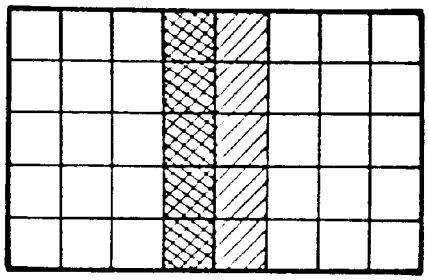

In FIGS. 2A–2C, FIG. 2A shows an image consisting of a black image portion formed as a matrix of 5×4 dots and a yellow image portion formed as a matrix of 5×4 dots, which are adjacent to each other. FIG. 2B shows a pattern of placing droplets of the recording-improvement liquid with respect to the image. As shown in the figure, a boundary area of the black image portion and the yellow image portion receives the dots of the recording-improvement liquid without thinning down, while a non-boundary area thereof receives the dots of the recording-improvement liquid after subjecting them in the thinning-down process to form a checkered pattern of the dots placed on the recording medium. Consequently, an image deterioration to be caused by the ink that runs on the recording medium can be prevented.

Furthermore, FIG. 2C shows an example of placing the droplets of the recording-improvement liquid on only the boundary area. In this case, a multiple-color image without an ink-running can be obtained with a moderation in use of the recording-improvement liquid to the utmost. In this case, however, the resulting image is of a poor water-resistant property.

As shown in the figures, by the way, the boundary area consists of two rows of dots (i.e., two dots in width) in which one is in the black image portion and another is in the yellow image portion. However, it is more preferable to make the boundary area by using two rows of each image portion (i.e., four dots in width).

The ink and the recording-improvement liquid used in the first and second embodiments are characterized by the follows.

Firstly, the recording-improvement liquid contains a cationic substance comprising a low-molecular component and a high-molecular component, while the ink contains an anionic dyestuff.

The following (1) and (2) are concrete examples of compositions of the ink and the recording-improvement liquid.

(1) The recording-improvement liquid is prepared by the steps of:

mixing and dissolving the following ingredients;

filtrating the mixture through a membrane filter (trade name: Floropore filter, manufactured by Sumitomo Denko Co., LTD.) of 0.22 $\mu$m in pore size under pressure; and adjusting pH of the filtrate to 4.8 by NaOH.

[The composition of the recording-improvement liquid]

a low molecular ingredient of a cationic compound stearyl trimethyl ammonium chloride (trade name: Electro-stopper QE, manufactured by Kao Co., LTD.) 2.0 parts by weight a high molecular ingredient of a cationic compound polyamine sulfone (average molecular weight: 5,000) (trade name: PAS-92, manufactured by Nitto

| | |
|---|---|
| Boseki, Co., LTD.) | 3.0 parts by weight |
| thiodiglycol | 10 parts by weight |
| water | 85 parts by weight |

Also, the ink comprising a dyestuff to be changed in insoluble by mixing with the above recording-improvement liquid is preferably prepared by the following steps and contains the following ingredients.

Each of yellow ink Y1, magenta ink M1, cyan ink C1, and black ink K1 is prepared by the process comprising the steps of: mixing the-following ingredients; and filtrating the mixture through a membrane filter (trade name: Chrolo-pore filter, manufactured by Sumitomo Denko, Co., LTD) of 0.22 $\mu$m in pore size under pressure.

The composition of each ink is as follows.

Y1

| | |
|---|---|
| C.I Direct yellow 142 | 2 parts by weight |
| Thiadiglycol | 10 parts by weight |
| Acetylenol EH (Kawaken fine-chemical, Co., LTD.) | 0.05 parts by weight |
| Water | 87.95 parts by weight |

M1

M1 is prepared from the same ingredients except that 2.5 parts by weight of acid red 289 is used as the dyestuff instead of C.I Direct yellow 142 and the water content is of 87.45 parts by weight.

C1

C1 is prepared from the same ingredients except that 2.5 parts by weight of acid blue 9 is used as the dyestuff instead of C.I Direct yellow 142 and the water content is of 87.45 parts by weight.

K1

K1 is prepared from the same ingredients except that 3 parts by weight of hood black 2 is used as the dyestuff instead of C.I Direct yellow 142 and the water content is of 86.95 parts by weight.

In accordance with the present invention, the above-mentioned recording-improvement liquid can be mixed with the above-mentioned ink on a surface of the recording medium or an inner side of thereof after permeation.

First of all, as a fist step of the reaction, the low molecular ingredient of the cationic substance in the recording-improvement liquid and the water-soluble dyestuff having an anionic group in the ink are reacted with each other by a function of their ionic interaction, resulting in their association as a reactant. Thus the reactant is separated from a liquid phase in a moment.

Secondary, as a second step of the reaction, the associated body of the above dyestuff and the low molecular cationic substance is absorbed in the high molecular ingredient in the recording-improvement liquid. Therefore, a size of the dye's aggregate generated by the above association becomes more large and thus it becomes difficult to enter a gap between fibers of the recording medium. As a result, only a liquid portion obtained by the solid/liquid separation penetrates into the recording medium to attain both a print quality and a property of retaining in the same place. Simultaneously, the viscosity of the above aggregate becomes high, so that the aggregate tends to stay in the same place and does not move with the flow of a solvent medium of the liquid. As in the case of recording a multiple-color image, therefore, adjoining dots of different color inks are not mixed with each other and thus any bleeding cannot be observed on a boundary of the adjoining dots. In fact the above aggregate is water-insoluble, so that the resulting image shows a perfect water-resistant property. Furthermore, the above aggregate is made of polymers which are effected as a protective structure, so that the resulting image shows the improved properties of light-fastness.

For carrying out the present invention, furthermore, there is no need to use a high-molecular cationic substance and a polyvalent metal salt. Alternatively, the amount of using these substances can be kept at the minimum when there is need to use them. Because they are only used as secondary substances for further improving an effects of the present invention. As a result, we are able to give another effect of the present invention in that the present invention enables to prevent a lowering of coloring properties of the dyestuff. The lower coloring properties of the dyestuff is a problem to be caused by using the high-molecular cationic substance and the polyvalent metal salt for obtaining an effect of water-resistant in the conventional method.

The recording medium to be used for carrying out the present invention is not limited to a certain medium. It can be preferably selected from any kinds of normal paper, such as copy paper, bond paper, and so on, which have been used in the conventional recording process. It is noted that coated paper prepared especially for the ink-jet recording and transparent paper for a overhead projector can be also applied as the recording medium of the present invention. Furthermore, general wood-free paper and glossy paper are preferably used in the present invention.

Embodiment 3

Figure 3:
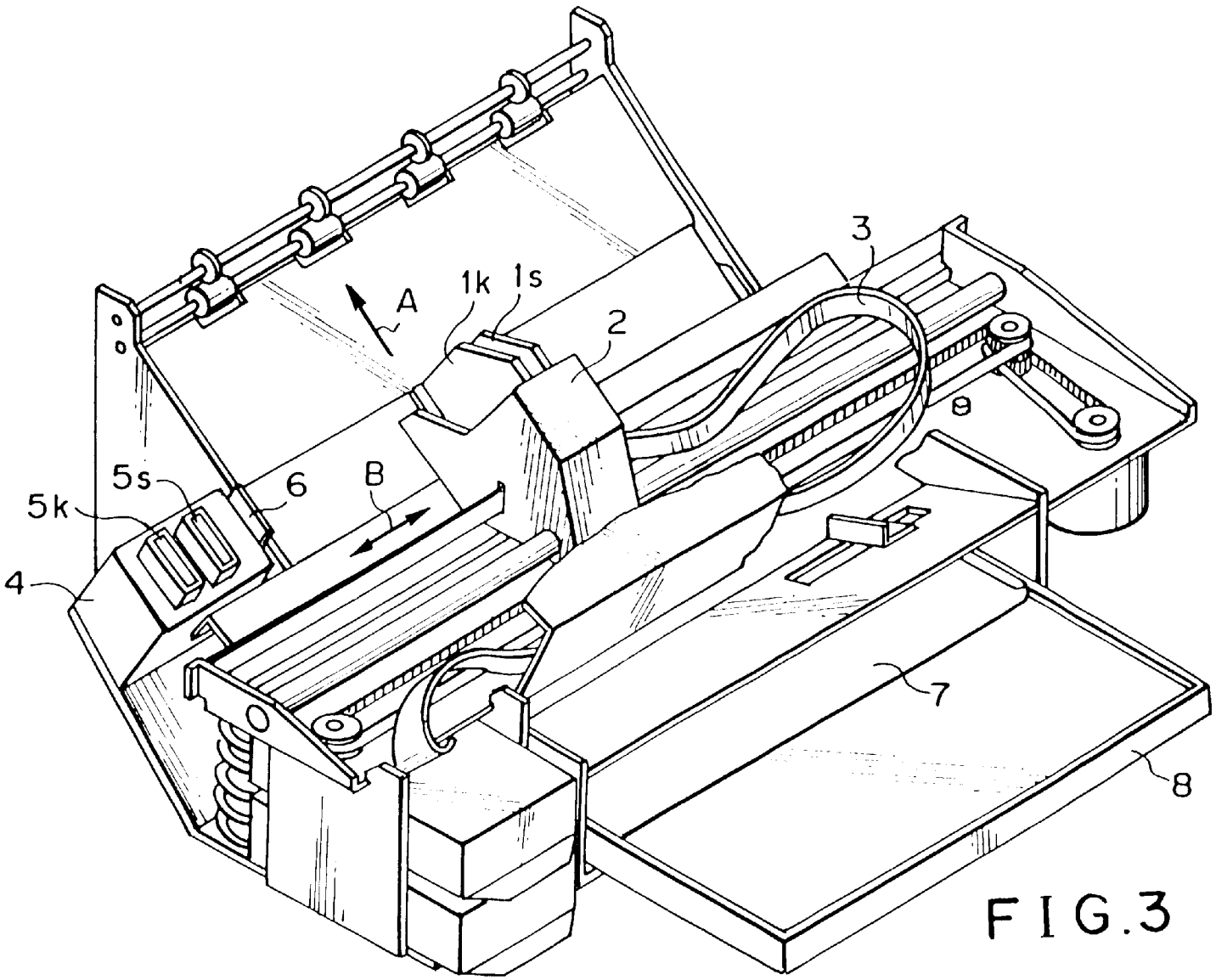
FIG. 3 is a schematic perspective view of an ink-jet printer as a preferred embodiment of the present invention.

FIG. 3 is a schematic perspective view of an ink-jet printer as one of preferred embodiments of the ink-jet recording apparatus in accordance with the present invention.

The printer comprises: a carriage 2 that carries a recording head 1*s* for ejecting a recording-improvement liquid and a recording head 1*k* for ejecting a black ink;

a flexible cable 3 for transmitting electric signals from a main body of the printer to the recording heads is, 1*k*; a capping unit 4 having a recovering means; a feed tray for supplying the recording medium 7; and so on.

The capping unit 4 has capping members 5*s* and 5*k* corresponding to the recording heads 1*s* and 1*k*, respectively, and a wiping blade 6 made of a rubber material or the like.

The printer having the above construction performs the recording by moving the recording heads 1*s*, 1*k* so as to sequentially scan over a surface of the recording medium (i.e., serial-scanning movement) in the direction (main-scanning direction) perpendicular to the feeding direction A of the recording medium. In this case, the recording medium is intermittently shifted at a distance corresponding to a recording width of the recording medium.

The printer of the present embodiment, the recording heads 1*s*, 1*k* are controlled by a control means (not shown) so as to eject the recording-improvement liquid prior to eject the ink.

Each of the recording heads 1*s*, 1*k* has 64 nozzles that eject about 80 ng of the recording-improvement liquid or the ink per each.

In the above recording head, means for generating energies required for ejecting the recording-improvement liquid and the ink is in the type (so-called bubble-jet type) of ejecting liquid by utilizing heat energies (i.e., utilizing a membrane-boiling phenomenon). In this type of the recording head, it is possible to perform a high-reliquid recording because the ejection orifices can be arranged at a high density. In addition, it is also possible to perform the ejection of liquid droplets with an extremely high-speed response because of growth and contraction of a bubble can be occurred quickly and appropriately by generating the bubble in the ink in a liquid path of the recording head by applying one driving-electric pulse signal on one nozzle.

Figure 4:
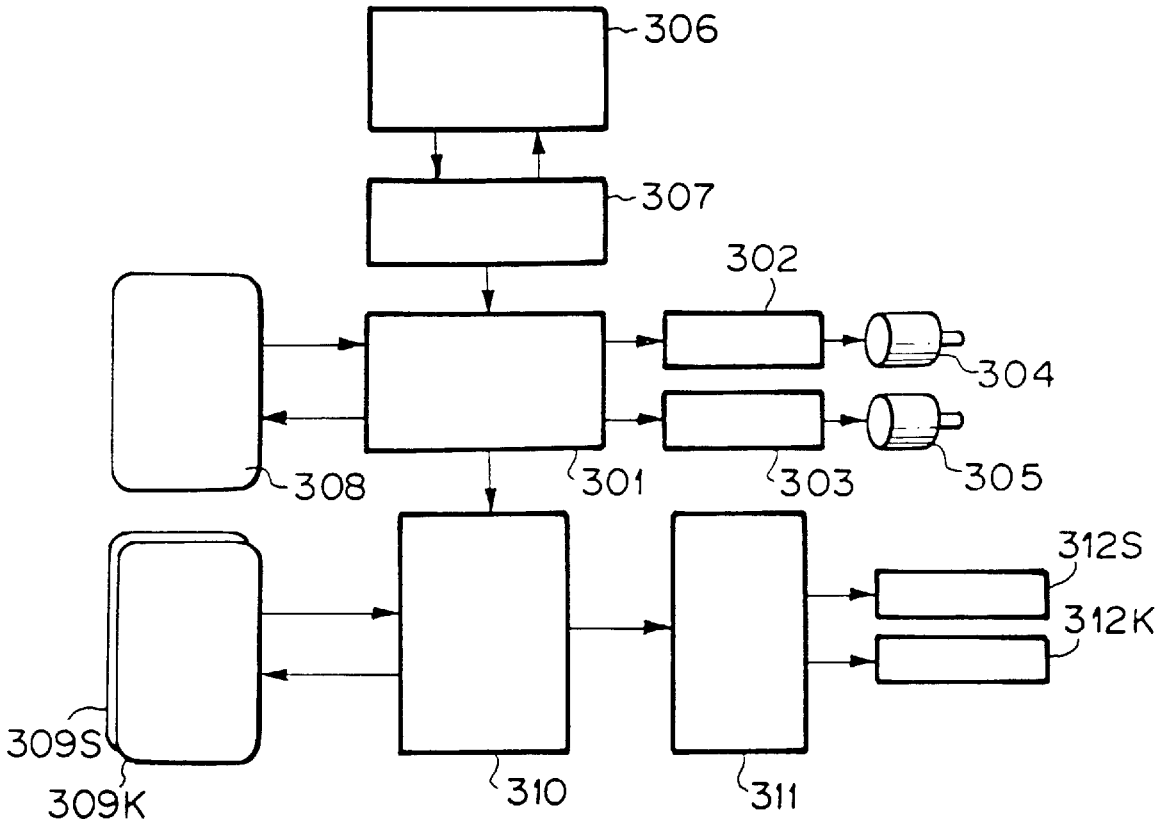
FIG. 4 is a block diagram for explaining the arrangement of electric parts for controlling the ink-jet printer.

FIG. 4 is a block diagram for explaining the arrangement of electric parts for controlling the above ink-jet printer.

Reference numeral 301 denotes a apparatus controller for controlling a whole of the printer. The apparatus controller 301 includes a microprocessor, a read-only memory (ROM) in which a control program is being stored, a random-access memory (RAM), and so on. Reference numeral 302 denotes a driver for driving the recording heads in the main-scanning direction, and also 303 denotes a driver for moving the recording medium in the sub-scanning direction. Furthermore, reference numerals 304 and 305 are motors corresponding to the drivers 302 and 303, respectively. Each motor receives the information concerned about its velocity, moving distance, and so on.

Reference numeral 306 denotes a host computer as an instrument of transmitting the information to be recorded to the printer of the-present invention. Reference numeral 307 is a receive buffer for temporally preserving the data provided from the host computer 306, until the data is read by a apparatus controller 301. Reference numeral 308 denotes a frame memory for expanding the data to be recorded into image data. That is, the frame memory has an enough capacity (i.e., enough size of memory) for storing the data to be required for the recording.

Hereinafter, we will illustrate the frame memory that has the capacity enough to record the data corresponding to a sheet of recording paper but not limited to. In the present invention, the memory size of the frame memory is not restricted.

Reference numeral 309 denotes a memory element for temporally remaining the data to be recorded. The memory size of the memory element is determined in accordance with the number of the nozzles formed on the recording heads.

Reference numeral 310 denotes a recording-control unit for appropriately controlling the recording heads by modulating the recording velocity, recording data, and so on, under an instruction of the apparatus controller. In the recording-control unit 310, furthermore, the data for ejecting the recording-improvement liquid is also prepared.

Reference numeral 311 is a driver for driving a recording head 312*s* for ejecting the recording-improvement liquid and a recording head 312*k* for ejecting the black ink, which is controlled by signals provided from the recording-control unit 310.

First of all, the host computer 306 sends image data to the receiving buffer 307 for temporally storing the data. Then the stored data is read out from the buffer 307 and exploding into the buffer 309. By means of the exploded data in the buffer 309, the recording-control unit 310 prepares the data for ejecting the recording-improvement liquid. After that, the movements of the recording heads 312*s* and 312*k* are controlled by means of the image data and the recording-improvement liquid's data in the buffers, respectively.

The following compositions of the recording-improvement liquid and the ink are used in the present embodiment.

[The composition of the ink]

| | |
|---|---|
| Glycerin | 5 parts by weight |
| Thiodiglycol | 5 parts by weight |
| Urea | 5 parts by weight |
| Isopropyl alcohol | 4 parts by weight |
| C. I. direct black | 3 parts by weight |
| Water | 78 parts by weight |

[The composition of the recording-improvement liquid]

| | |
|---|---|
| Polyaclylamine-hydrochloride | 1 part by weight |
| tributyl amine chloride | 1 part by weight |
| thiodiglycol | 10 parts by weight |
| acetilenol | 0.5 parts by weight |
| water | 87.5 parts by weight |

In this embodiment, the data for ejecting the recording-improvement liquid is prepared by using a thinning-down mask shown in FIG. 1F.

By using the recording heads, the ink, the recording-improvement liquid, and the printer in accordance with the present invention, which are explained in the above description, a distinct image with water-resistibility is obtained.

Embodiment 4

Figure 5:
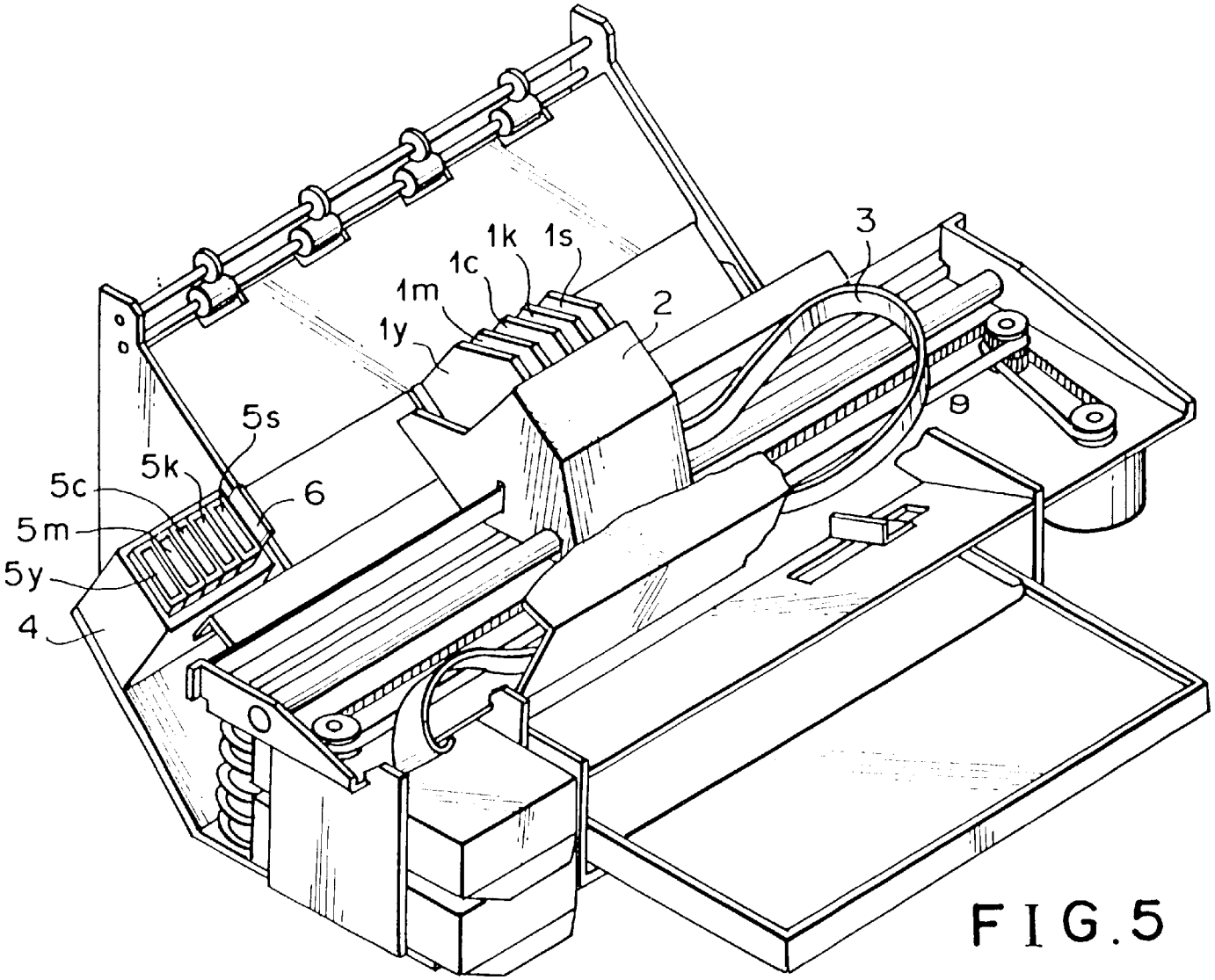
FIG. 5 is a schematic perspective view of an ink-jet printer as a preferred embodiment of the present invention.

FIG. 5 is a schematic perspective view of the color ink-jet printer as one of the preferred embodiment of the ink-jet recording apparatus in accordance with the present invention. In this embodiment, the construction of the printer is much the same as that of the printer of the third embodiment except that a plurality of recording heads and the printer's construction that corresponds to these heads.

In the figure, each reference numeral denotes each elements of the construction as follows: 1*y* denotes a yellow-ink recording head; 1*m* denotes a magenta-ink recording head; 1*k* denotes a black-ink recording head; l*b* denotes a recording head for recording-improvement liquid; 2 denotes a carriage on which the recording heads are mounted; 3 denotes a flexible cable for sending electric signals from a main body of the printer to the recording heads; 4 denotes a capping unit having a head-recovering means; 5*y*, 5*m*, 5*c*, 5*k*, and 5*b* denote capping members that correspond to the recording heads 1*y*, 1*m*, 1*c*, 1*k*, and 1*b*, respectively; and 6 denotes a wiping blade made of a rubber material or the like.

Each of the recording heads 1*y*, 1*m*, 1*c*, 1*k*, and 1*b* has 64 nozzles that eject about 40 ng of the recording-improvement liquid or the ink per each.

In this embodiment, the following compositions of inks are used, while the recording-improvement liquid used in the present embodiment has the same composition as that of Embodiment 3.

| 1. Yellow | |
|---|---|
| triethylene glycol | 7 parts by weight |
| hexane triol | 7 parts by weight |

-continued

| | |
|---|---|
| isopropyl alcohol | 2.5 parts by weight |
| acetilenol | 0.02 parts by weight |
| C. I. direct yellow 86 | 1.5 parts by weight |
| water | 81.98 p.arts by weight |
| 2. Magenta | |
| triethylene glycol | 7 parts by weight |
| hexane triol | 7 parts by weight |
| isopropyl alcohol | 1.5 parts by weight |
| acetilenol | 0.01 parts by weight |
| C. I. acid red 289 | 1.5 parts by weight |
| Water | 82.99 parts by weight |
| 3. Cyan | |
| triethylene glycol | 7 parts by weight |
| hexane triol | 7 parts by weight |
| isopropyl alcohol | 1.5 parts by weight |
| acetilenol | 0.01 parts by weight |
| C. I. direct blue | 1.5 parts by weight |
| Water | 81.99 parts by weight |
| 4. Black | |
| triethylene glycol | 6 parts by weight |
| hexane triol | 6 parts by weight |
| butyl alcohol | 2 parts by weight |
| acetic acid lithium | 0.1 parts by weight |
| C. I. direct black 154 | 3 parts by weight |
| Water | 82.9 parts by weight |

Figure 6:
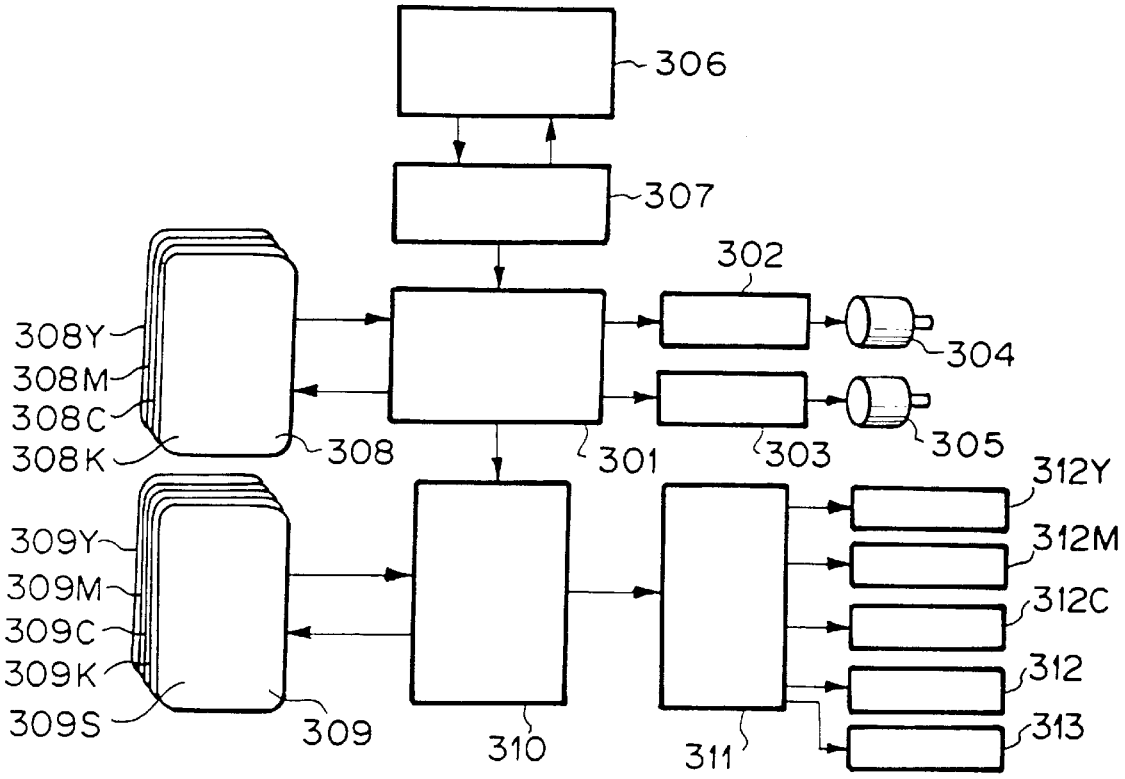
FIG. 6 is a block diagram for explaining the arrangement of electric parts for controlling the ink-jet printer.

FIG. 6 is a block diagram for explaining the arrangement of electric parts for controlling the above color ink-jet printer shown in FIG. 5. In the figure, the common reference numerals with FIG. 3 denote the same parts. In this embodiment, furthermore, the electric control of the printer is most the same as that of the above embodiment, so that its explanation is omitted.

The color ink-jet printer of the present embodiment is, as shown in FIG. 2C, in the type of shooting droplets of the recording-improvement liquid in a border region between adjacent different color images prior to eject ink droplets, to prevent a spread of the ink on a surface of the recording medium.

Figure 7:
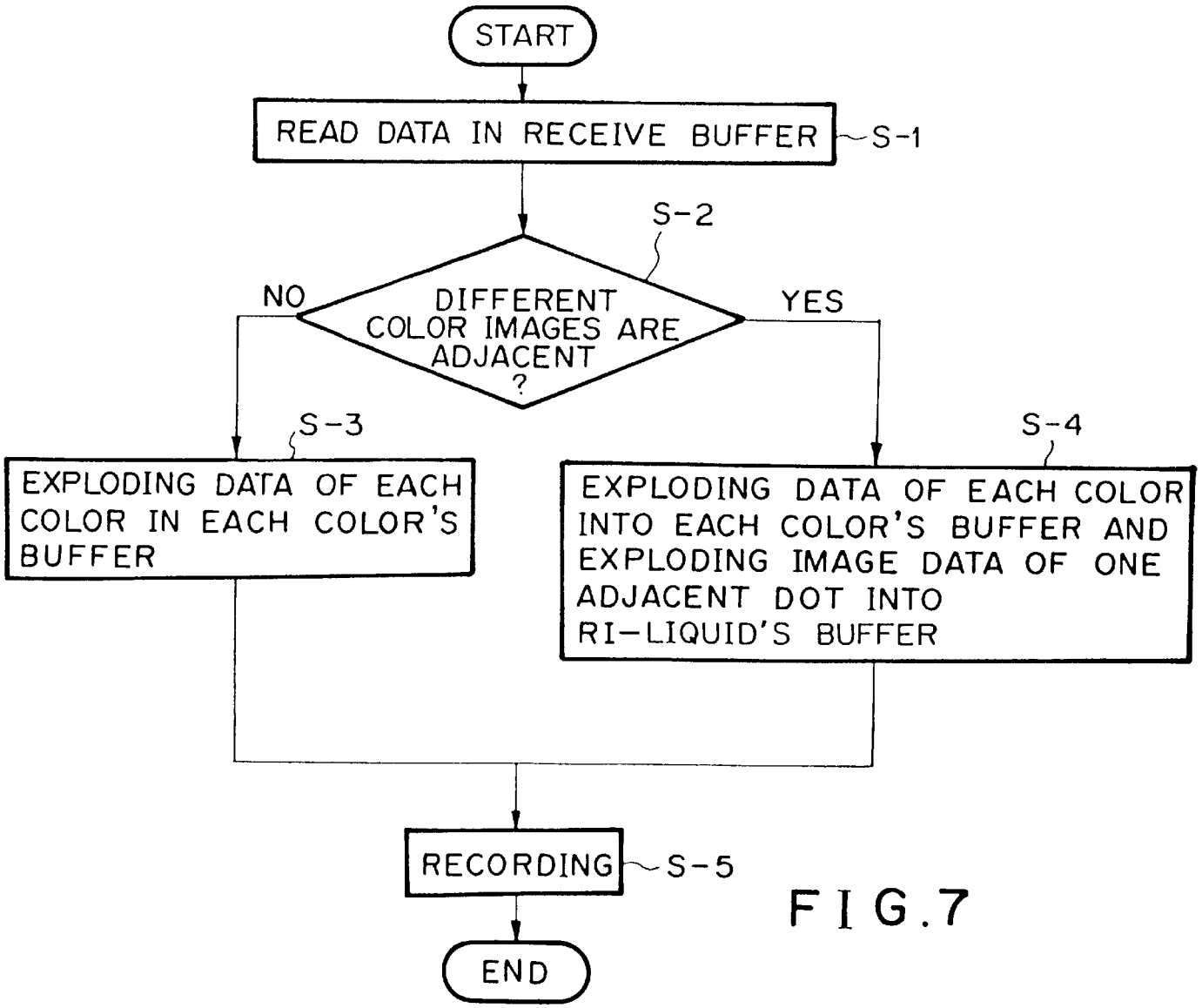
FIG. 7 is a simplified flow-sheet for illustrating an ink-jet recording movement to be performed by the ink-jet printer.

The recording behavior of the printer will be illustrated in detail with reference to FIG. 7.

In a first step (S-1), an image data is transmitted from the host computer 306 of FIG. 6 to the printer and then the input image data is stored in the receive buffer 307. The apparatus controller reads out the stored data in the buffer to process.

In a second step (S-2), the read-out image data is processed for judging whether an image to be formed by the data includes a boundary between adjacent different color image portions. If it is included (YES), the process goes into a step S-3.

In the step S-3, each of yellow-, magenta-, cyan-, and black-image data is exploded in each of color's buffers, 309Y, 309M, 309C, and 309K, respectively. However, there is no explosion of the data for ejecting the recording-improvement liquid (in the figure, RI liquid) from its recording head. Then the process goes into a step S-5.

In the step S-5, the recording movement is performed in accordance with the image data in each buffer.

In the above step S-6, if the data does not include the boundary between adjacent different color image portions (NO), on the other hand, the process goes into a step S-4.

In the step S-4, each of yellow-, magenta-, cyan-, and black-image data is exploded in each of color's buffers 309Y, 309M, 309C, and 309K. In addition, there is an explosion of the data in the recording-improvement liquid's buffer 309S for ejecting the recording-improvement liquid from its recording head. Then the process goes into a step S-5 where the recording movement is performed in accordance with the image data in each buffer and the data in the recording-improvement liquid's buffer.

Consequently, a distinct multiple-color image without a spread of the ink in the boundary of colors is obtained by performing the multiple-color recording by the color ink-jet printer explained in the above description.

Embodiment 5

The fifth embodiment of the ink-jet recording apparatus has a preferably modified construction with respect to the above fourth embodiment. That is, the color ink-jet printer of the present embodiment is not only able to prevent a spread of the ink when the different color image portions are adjacent to each other, but also able to provide an image having improved properties of water-resistant.

In this embodiment, the construction of the color ink-jet printer is much the same as that of the printer of the above fourth embodiment except as follows. That is, the printer of the present embodiment ejects the recording-improvement liquid on the whole boundary area when the different color images are adjacent to each other. In this case, the other regions receives the recording-improvement liquid ejected by the recording head in accordance with the data smaller than the image data.

Figure 8A:
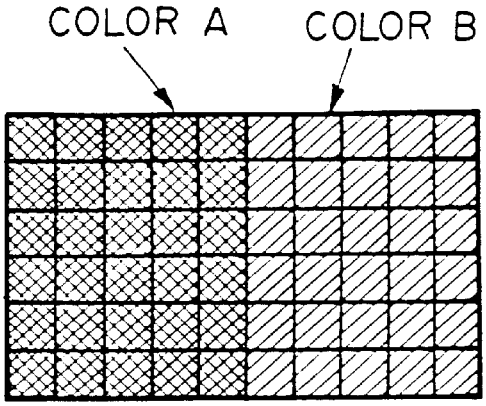
FIGS. 8A–8D are schematic representations of an image for illustrating an ink-jet recording method in accordance with the present invention, where
Figure 8B:
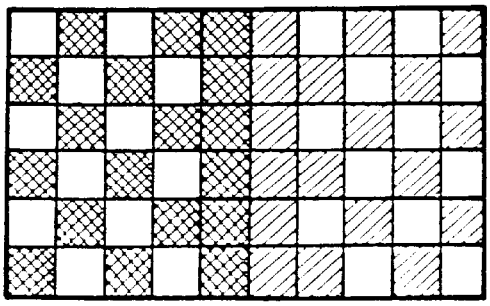
Figure 8C:
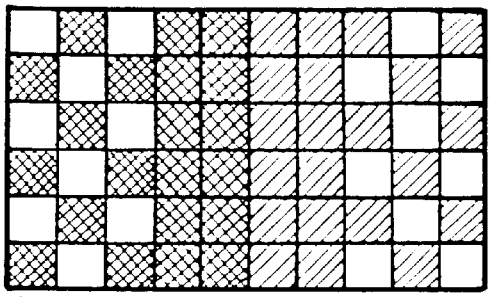
Figure 8D:
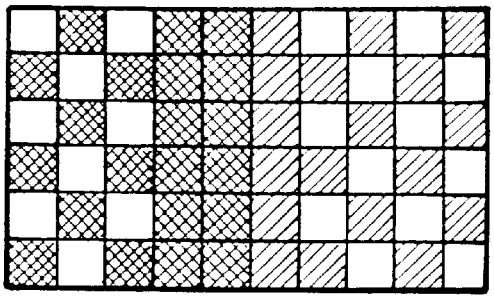

FIGS. 8A–8D are schematic illustrations of the image to be formed by the color ink-jet printer of the present embodiment for explaining the way of shooting droplets of the recording-improvement liquid. The image is formed as a matrix of 6×10 dots. In the figure, FIG. 8A shows an original image comprising two different color portions (i.e., portions of color A and color B). These two portions are adjacent to each other. FIG. 8B is for explaining the way of ejecting the recording-improvement liquid when each of the colors A and B is a first order color expressed by means of yellow, magenta, and cyan. A meshed square indicates a part corresponding to the color A, where the recording-improvement liquid is applied. A slant-line square indicates a part corresponding to the color B, where the recording-improvement liquid is applied. In each color portions, a peripheral area adjacent to the boundary line BL and corresponding to a matrix of 1×6 dots of the image receives the recording-improvement liquid. On the other hand, another receives the droplets of the recording-improvement liquid in accordance with a result of thinning down the number of the dots to form a checkered pattern of the squares where the liquid is applied. In the case that the image is formed by the colors A and/or B or by a secondary color expressed by blue, green, and red, as shown in FIG. 8C and FIG. 8D, a peripheral area adjacent to the boundary line BL and corresponding to a matrix of 2×6 dots of the image receives the recording-improvement liquid. On the other hand, as shown in FIG. 8B, another receives the droplets of the recording-improvement liquid in accordance with a result of thinning down the number of the dots to form a checkered pattern of the squares where the liquid is applied.

Figure 9:
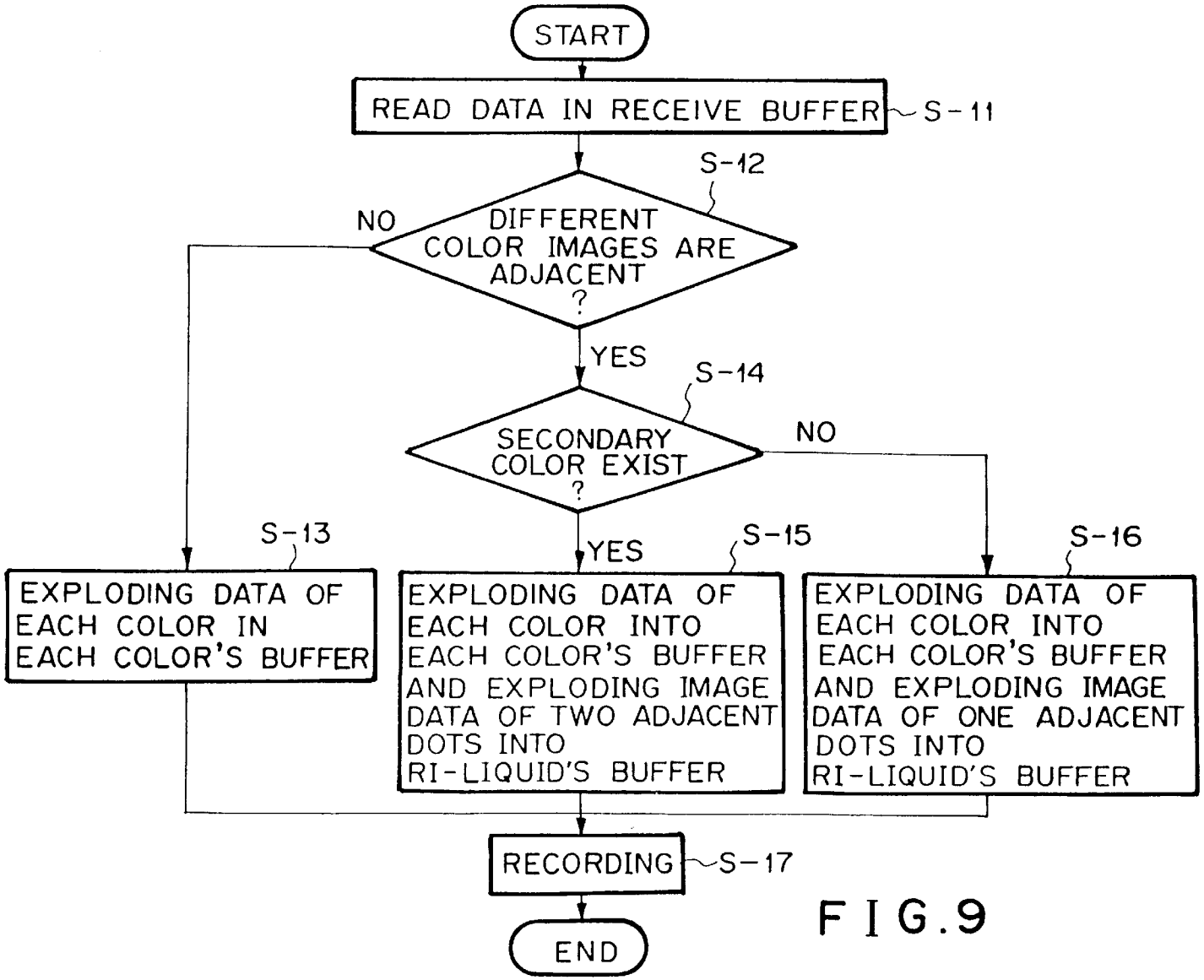
FIG. 9 is a simplified flow-sheet for illustrating an ink-et recording movement to be performed by the ink-jet printer.

FIG. 9 is a simplified flow sheet for illustrating the recording movement of the present embodiment. In the figure, steps S-11, S-12, and S-13 are the same as the steps S-1, S-2, and S-3 of FIG. 7 (Embodiment 4), respectively. Therefore, they need no explanation.

When the above step 13 concludes that there is a boundary between adjacent different color image portions, a step S-14 performs a judgment whether a secondary color is used in each color image. If the secondary color is found (YES), the process goes into a step S-15. If there is not found (NO), on the other hand, the process goes into a step S-16.

In the step S-15, as the step S-14 concluded that at least one of the color image portions adjacent to each other includes the secondary color, image data corresponding to one adjacent dot is exploded into a buffer of the recording-improvement liquid, while the image data corresponding each of other colors is exploded into each color's buffer after.

In the step S-16, on the other hand, the recording movement is performed in accordance with the data that is expanded into the buffers of the colors and the recording-improvement liquid.

Especially in the case that the adjacent image portions include the secondary color, the boundary area of the different colors receives comparatively excess amount of the recording-improvement liquid. Consequently, a distinct multiple-color image without a spread of the ink in the boundary of the colors is obtained by performing the multiple-color recording by the color ink-jet printer explained in the above description.

Embodiment 6

In the third embodiment, the thinning-down mask shown in FIG. 1F is used. In this embodiment, however, a high-quality image having an extremely sharp outline is obtained by using the thinning-down mask shown in FIG. 1C.

In the fifth embodiment, by the way, at least one of the adjacent images is of the secondary color, the recording-improvement liquid is ejected on the whole portion corresponding to two dots in width of the boundary. In this embodiment, however, the amount of the recording-improvement liquid to be consumed can be decreased by ejecting the liquid by the way of the follows as shown in FIGS. 8A–8D.

FIG. 8A shows an image consisting of a color A image portion (5×6 dots) and a color B image portion (5×6 dots) which are adjacent to each other. FIGS. 8B–8D show patterns of placing droplets of the recording-improvement liquid with respect to the image. As shown in the figure, a boundary area of the color A image portion and the color B image portion receives the dots of the recording-improvement liquid without thinning down, while a non-boundary area thereof receives the dots of the recording-improvement liquid after subjecting them in the thinning-down process to form a checkered pattern of the dots placed on the recording medium. The boundary area of FIG. 8B is formed as a matrix of 2×6 dots, including one dot line of the color A and one dot line of the color B. The boundary area of FIG. 8C is formed as a matrix of 4×6 dots, including two dot lines of the color A and two dot lines of the color B. Furthermore, the boundary area of FIG. 8D is formed as a matrix of 3×6 dots, including two dot lines of the color A and one dot line of the color B. When the color A is a secondary color and the color B is a primary color in FIG. 8A, it is not only possible to prevent an image deterioration to be caused by the ink running on the recording medium but also to decrease an amount of the recording-improvement liquid to be consumed.

Embodiment 7

In the fourth embodiment, all dots in the most outside portion of the image receive the recording-improvement liquid in accordance with the complete data, while the dots on the inside of the image receive the recording-improvement liquid in accordance with the data where the number thereof is thinned down. In this embodiment, on the other hand, the dots on the inside of the image does not receive the recording-improvement liquid. Therefore, the present embodiment is able to reduce the use of a large amount of the recording-improvement liquid to be used, without losing a sharpness of the image.

For enforcing aforementioned embodiments 1–7, useful ink is not limited to especially the dyestuff ink but also it is possible to use the ink comprising dispersed pigments. In the latter case, an useful recording-improvement liquid can be an agglutination of the pigment. The followings are examples of the pigment ink that causes an agglutination by mixing with the above-mentioned colorless liquid A. That is, as will be described, each color ink of yellow Y2, magenta M2, cyan C2, and black K2 is prepared in the form of comprising a pigment and an anionic compound.

1. Black ink K2

An anionic high-molecule P-1 (stylene-methacrylic acide-ethylacrylate, an acidic value 400, an average molecular weight 6,000, an aqueous liquid containing 20% solid material, and a potassium hydroxide as a liquid neutralizing agent) is used as a dispersion agent. The following materials are filled in a vertical batch-type sand mill (manufactured by Imex Co., LTD) and then glass beads of 1 mm in diameter are provided as media to fill the hole tightly. After that, the mixture is subjected to a water-cooled dispersion treatment for three hours, resulting that a fluid dispersion having the viscosity of 9 cps and the pH of 10.0. The obtained fluid dispersion is centrifuged by a centrifuge to separate contained materials of different specific gravities to remove coarse particles. Consequently, a dispersion body of carbon-black with an average particle diameter of 100 nm.

[Composition of the carbon-black dispersion body]

| | |
|---|---|
| P-1 aqueous liquid (including 20% of solidified portion) | 40 parts |
| Carbon black Mogul L (Cablack made) | 24 parts |
| Glycerin | 15 parts |
| Ethyleneglycol monobutyl ether | 0.5 parts |
| Isopropyl alcohol | 3 parts |
| Water | 135 parts |

A black ink K2 for the ink-jet recording, comprising pigments as sufficiently-dispersed bodies obtained by the above procedure, is thus prepared. A solidified portion of the final preparation is about 10%.

2. Yellow ink Y2

An anionic high-molecular substance P-2 (stylene-acryl acid-methylmetaacrylate, an aqueous liquid having an acid value of 280, a molecular weight of 11,000, and a solid content of 20%, and neutralizer diethanolamine) is used as a dispersion agent. The dispersion is managed similarly to the process of preparing the black ink K2 by means of the following materials. Consequently, a yellow color dispersion body of 103 nm in average particle diameter is obtained.

[Composition of the yellow dispersion body]

| | |
|---|---|
| P - 2 aqueous liquid (20% of solid content) | 35 parts |
| C.I. Pigment yellow 180 (Trade name: Nova parm | 24 parts |

-continued

| | |
|---|---|
| yellow - PH-G, manufactured by Hexist Co., LTD.) | |
| Triethylene glycol | 10 parts |
| Diethylene glycol | 10 parts |
| Ethyleneglycol monobutylether | 1.0 parts |
| Isopropyl alcohol | 0.5 parts |
| Water | 135 parts |

A yellow ink Y2 for the ink-jet recording, comprising pigments as sufficiently-dispersed bodies obtained by the above procedure, is thus prepared. A solidified portion of the final preparation is about 10%.

3. Cyan ink C2

The anionic high-molecular substance P-1, which is used in the preparation of the black ink K2, is also used as a dispersion agent for preparing the cyan ink Y2. The dispersion treatment is managed similar to the process of preparing the carbon-black dispersion by means of the following materials. Consequently, a cyan color dispersion body of 120 nm in average particle diameter is obtained.

[Composition of the cyan dispersion body]

| | |
|---|---|
| P - 1 aqueous liquid (20% of solid content) | 30 parts |
| C.I. Pigment blue 15:3 (Trade name: Fastgenbul-FGF, manufactured by Dai Nippon Ink Chemicals, Co., LTD.) | 24 parts |
| Triethylene glycol | 10 parts |
| Glycerin | 15 parts |
| Diethyleneglycol monobutylether | 15 parts |
| Isopropyl alcohol | 3 parts |
| Water | 135 parts |

A cyan ink C2 for the ink-jet recording, comprising pigments as sufficiently-dispersed bodies obtained by the above procedure, is thus prepared. A solidified portion of the final preparation is about 9.6%.

4. Magenta ink MC2

The anionic high-molecular substance P-1, which is used in the preparation of the black ink K2, is also used as a dispersion agent for preparing the magenta ink M2. The dispersion treatment is managed similar to the process of preparing the carbon-black dispersion by means of the following materials. Consequently, a magenta color dispersion body of 115 nm in average particle diameter is obtained.

[A composition of the magenta dispersion body]

| | |
|---|---|
| P - 1 aqueous liquid (20% of solid content) | 24 parts |
| C.I. Pigment red 122 (manufactured by Dai Nippon Ink Chemicals, Co., LTD.) | 24 parts |
| Glycerin | 15 parts |
| Isopropyl alcohol | 3 parts |
| Water | 135 parts |

A magenta ink M2 for the ink-jet recording, comprising pigments as sufficiently-dispersed bodies obtained by the above procedure, is thus prepared. A solidified portion of the final preparation is about 9.2%.

In the above embodiments 1–7, the ink-jet recording methods and the ink-jet recording apparatuses using such methods have been explained in detail. As described above, a high-density image having an excellent water-resistant property compared with that of the conventional one can be obtained regardless of recording on a sheet of ordinary paper, under the condition of attaining a low running cost by a moderation in use of the recording-improvement liquid to the utmost. In the case of forming a multiple-color image, furthermore, the high-coloring image can be obtained without causing an ink-running on the boundary of different colors.

Hereinafter, we will illustrate other preferred embodiments of the present invention, each of which is able to provide with a high-density black image without causing any feathering and also provide with a high-quality multiple-color image regardless of including both a black image and a color image without causing a spread of ink on the boundary area between the images.

Embodiment 8

Figure 10:
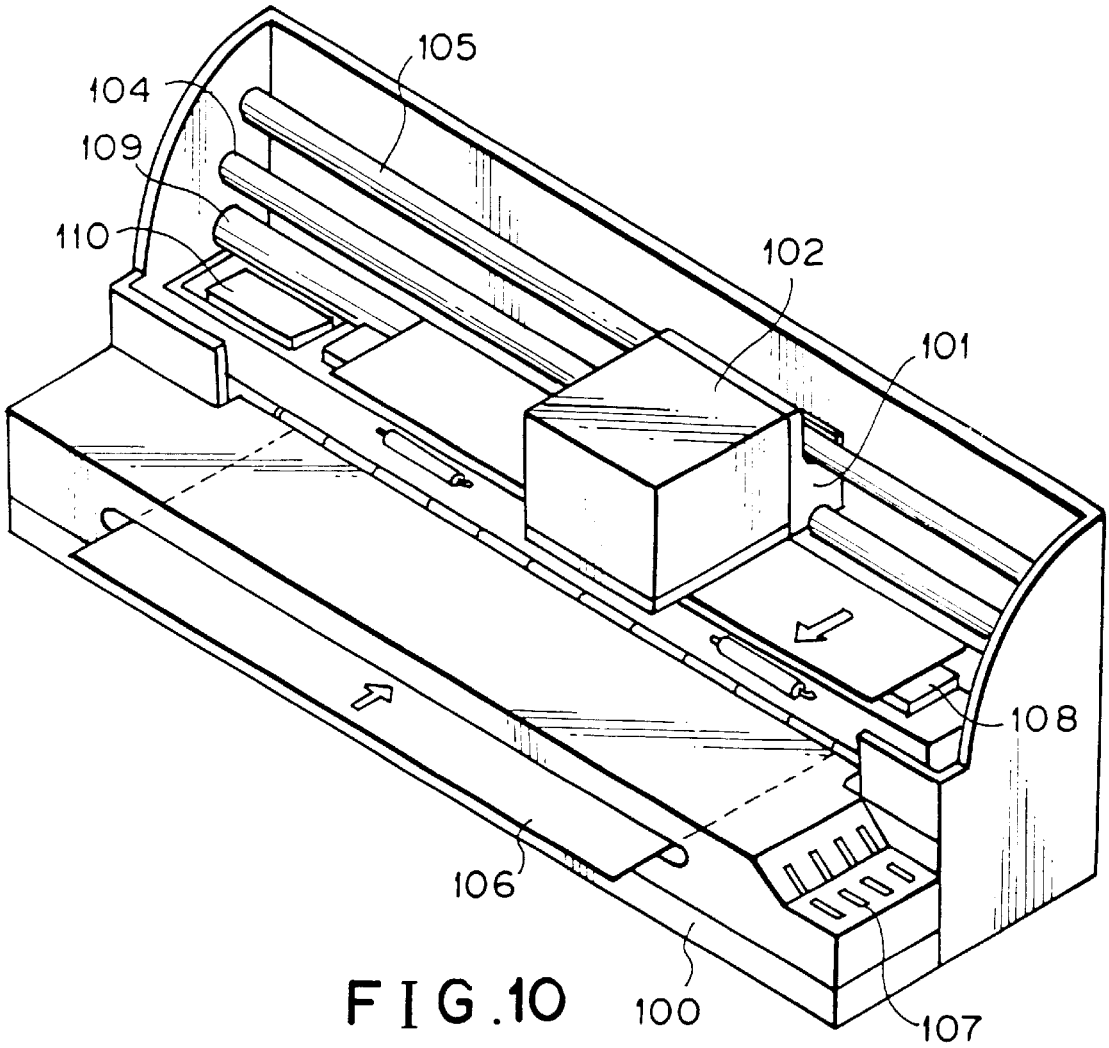
FIG. 10 is a schematic perspective view of an ink-jet printer as a preferred embodiment of the present invention.
Figure 11:
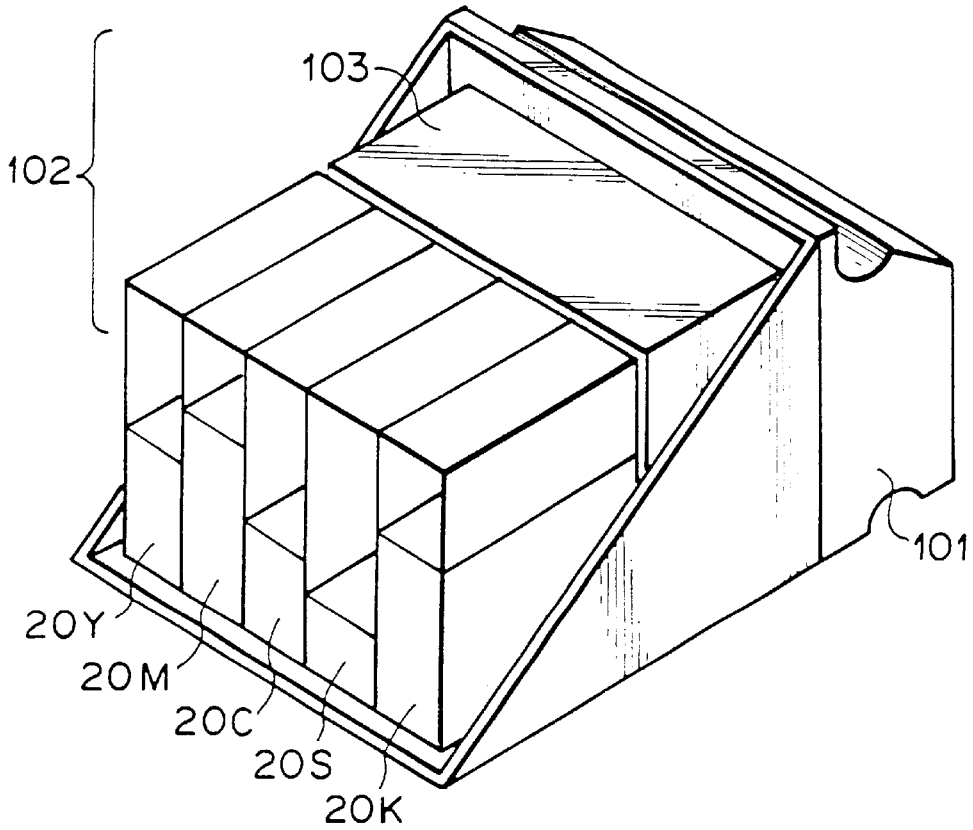
FIG. 11 is a schematic perspective view of an ink-jet recording head unit to be mounted on the printer of the present invention.
Figure 12:
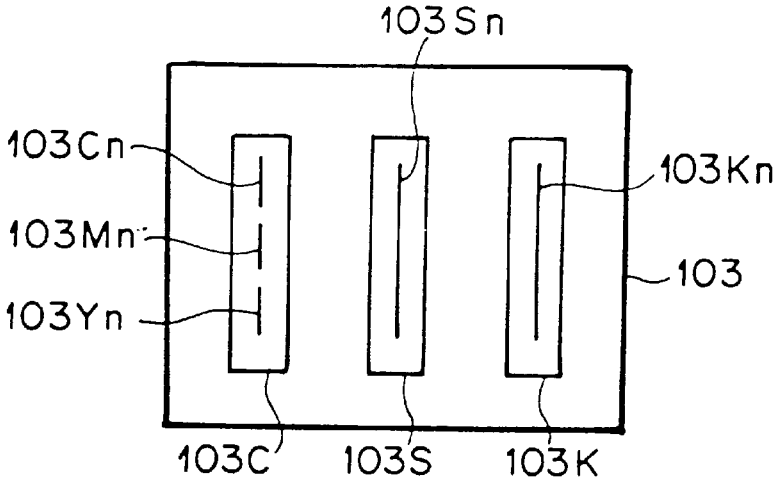
FIG. 12 is a front view of an ink-jet recording head unit to be mounted on the ink-jet recording printer as a preferred embodiment of the present invention, for illustrating groups of nozzles formed on the recording head unit.

FIGS. 10, 11, and 12 is illustrated for explaining an ink-jet recording printer as one of preferred embodiment of the present invention. FIGS. 10 and 11 are schematic perspective views of the printer and an ink-jet recording head unit, respectively. FIG. 12 is a schematic plan view of the ink-jet recording head unit.

The ink-jet recording printer 100 comprises:

- a carriage 101 for loading the head unit 102 in which color-recording heads and ink-tanks which are removably connected with each other;
- a feeding means 109 for feeding a recording medium:
  - a control means (not shown) for controlling the movements of these devices.

The ink-jet recording head is responsible for ejecting ink droplets from a plurality of ejection orifices thereof and performs its serial-scanning movement (i.e., the head scans over a surface of the recording head, sequentially) in the direction (main-scanning direction) perpendicular to the feeding direction (sub-scanning direction) of the recording medium. On the other hand, the recording medium is intermittently shifted at a distance corresponding to a recording width of the recording medium.

In this embodiment, the recording head to be mounted on the printer comprises three different groups of nozzles:

- a first group of nozzles for ejecting ink droplets of a first color:
  - a second group of nozzles for ejecting ink droplets of a second color different from the first one; and
  - a third group of nozzles for ejecting a colorless or light-color aqueous liquid (hereinafter, also referred as recording-improvement liquid) that comprises a chemical compound responsible for condensing or precipitating a color material in the ink by contacting with the ink ejected from the above first or second group of nozzles.

In the above recording head, means for generating energies required for ejecting the recording-improvement liquid and the ink is in the type (so-called bubble-jet type) of ejecting liquid by utilizing heat energies (i.e., utilizing a membrane-boiling phenomenon). In this type of the recording head, it is possible to perform a high-reliquid recording because the ejection orifices can be arranged at a high density. In addition, it is also possible to perform the ejection of liquid droplets with an extremely high-speed response because of growth and contraction of a bubble can be occurred quickly and appropriately by generating the bubble in the ink in a liquid path of the recording head by applying one driving-electric pulse signal on one nozzle.

Hereinafter, the ink-jet recording apparatus of the present invention will now be described in more detail with reference to the drawings.

FIG. 10 is a schematic perspective view of an ink-jet printer as one of the preferred embodiments of the ink-jet recording apparatus in accordance with the present invention.

A recording medium 106 inserted in a feeding position of the printer 100 is moved to a printing-possible region of a printing head unit 102 by means of a feed roller 109. A lower part of the recording medium in the printing-possible region is disposed on a platen 108. A carriage 101 is constructed so as to be able to move in the direction decided by two guide axises 104 and 105, so that it performs a round-trip scanning movement on the printing-possible region. Furthermore, the print head unit 102 is mounted on the carriage 101. The printing head unit 102 comprises: a printing heads for ejecting inks corresponding to a plurality of colors and a recording-improvement liquid; and ink tank for supplying the inks to the recording heads, respectively. The ink-jet printer of the present embodiment, the plurality of the colors to be used are four colors of black (Bk), cyan (C), magenta (M), and yellow (Y).

For the left end of the region where the carriage is able to move, there are a recovering unit 110 at a, lower part of the left end. The recovery unit 110 is responsible for detachably capping the ejection orifices of the printing head at the period of non-printing. Hereinafter, we refer the left end of the region as a home position.

Reference numeral 107 denotes a switch portion and a display portion. The switch portion is used for switching ON-OFF of an electric supply of the printer, setting up various printing modes, and so on, while the display portion displays the condition of the printer.

FIG. 11 is a schematic perspective view of the print head unit 102 for explaining the construction thereof. In this figure, every ink tanks of black, cyan, magenta, and yellow colors and a storage tank of the recording-improvement liquid are exchangeable, independently.

The carriage carries a printing head 103 and for ejecting color inks of black, cyan, magenta, and yellow and the recording-improvement liquid and a black-ink tank 20K, a cyan-ink tank 20C, a magenta-ink tank 20M, a yellow-ink tank 20Y, and a recording-improvement liquid tank 20S. Each tank connects with the printing head 103 through a connecting portion for supplying the ink or the recording-improvement liquid into an inlet of the tank. It is noted that the structures of the above tanks are not limited to that in FIG. 11. Other structures, for example, it is possible to construct the recording-improvement tank and the black-ink tank in one body or to construct the C-, M-, and Y-ink tanks in one body.

FIG. 12 is a schematic front view of the printing head 103 for explaining three groups of nozzles formed on a front surface (a side facing to the recording medium) of the printing head 103. The printing head 103 comprises a first group 103K of nozzles for ejecting the black ink; a second group 103C of nozzles for ejecting color inks except the black; and a third group 103S of nozzles for ejecting the recording-improvement liquid.

Furthermore, the nozzle group 103S for ejecting the recording-improvement liquid is disposed between the nozzle group 103K for ejecting the black ink as a first color and the nozzle group 103C for ejecting the color ink. The nozzle group 103C is positioned on the side of the home position, while the nozzle group 103 K is positioned on the other side thereof. In addition, each of the nozzle groups 103K and 103S has 160 nozzles which are indicated by reference numeral 103S*n* or 103K*n* in the figure. On the other hand, the nozzle group 103C for ejecting the color ink comprises 48 nozzles 103Y*n* for yellow ink, 48 nozzles 103M*n* for magenta ink, and 48 nozzles 103C*n* nozzles for cyan ink. These sets of nozzles, 103Y*n*, 103M*n*, and 103C*n* are arranged at intervals of the length equivalent to 8 nozzles. Furthermore, the nozzles 103Y*n* for the yellow ink is disposed at the lower of a feed path of the recording medium, while nozzles 103C*n* is disposed at the upper thereof.

The volume of ink to be ejected from each nozzle is approximately 80 ng for each of the black-ink nozzles 103k*n*, and approximately 40 ng for each of the other nozzles of cyan, magenta, yellow, and the recording-improvement liquid.

Figure 13:
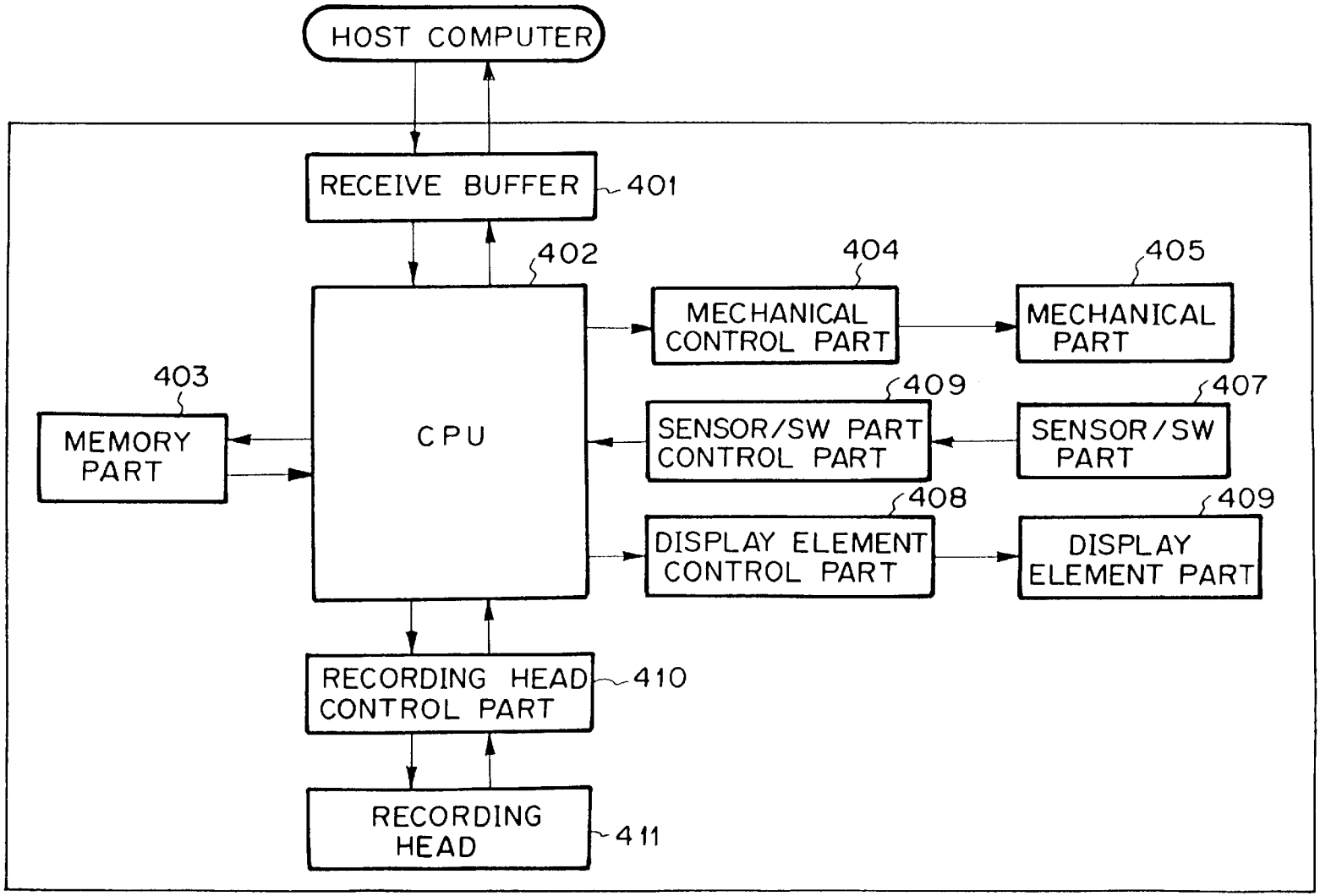
FIG. 13 is a block diagram for explaining the arrangement of electric parts for controlling the ink-jet printer.

FIG. 13 is a schematic block diagram of the ink-jet printer described above. A receiving buffer 401 receives data of characters, pictures, and so on to be recorded (hereinafter, also referred as image data), which are produced by a host computer. In addition, the receiving buffer 401 produces data for confirming a correct transmission of the image data; data for informing a mechanical condition of the printer; and so on, and transmits these data to the host computer. The data received by the receiving buffer 401 is transmitted to a memory part 403 under the control of a central processing unit (CPU) 402 and then temporarily memorized in a random access memory (RAM). The CPU 402 directs a mechanical control part 404 to drive a mechanical part 405 including a carriage motor, a line-feed motor, and so on. Any additional data to be required for controlling the recording movement may be provided by means of a sensor/SW part 407 including sensors and switches (SW). Then a control part 409 for controlling the sensor/SW part 407 sends a signal into the CPU 402 in accordance with an output of the sensor/SW part 407. The CPU 402 also directs a display element control part 408 to control a display element part 409 including a liquid crystal (LCD) display and light-emitting diodes (LEDs). A recording head control part 410 controls the motion of a recording head unit 411 by carrying out a set of instructions generated from the CPU 402. This kind of the control includes a first mode and a second mode. The first mode is responsible for driving the first and/or second nozzle groups in accordance with the image data. The second mode is responsible for driving the third nozzle group independently from the first mode. Also, the above control part 410 sends an information about temperature change or the like in the recording head 411 to evaluate the condition of the recording head 411.

Figure 14A:
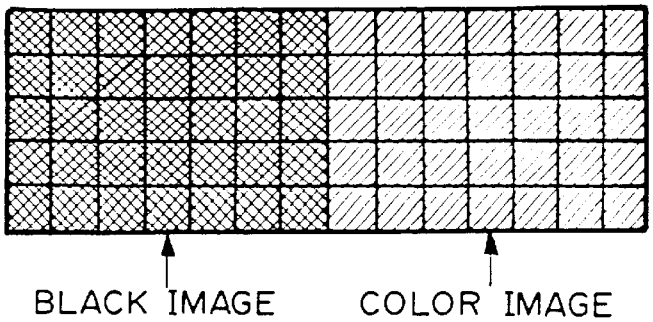
FIGS. 14A and 14B are schematic representations of an image to be recorded by an ink-jet recording printer as a preferred embodiment of the ink-jet recording apparatus in accordance with the present invention, where
Figure 14B:
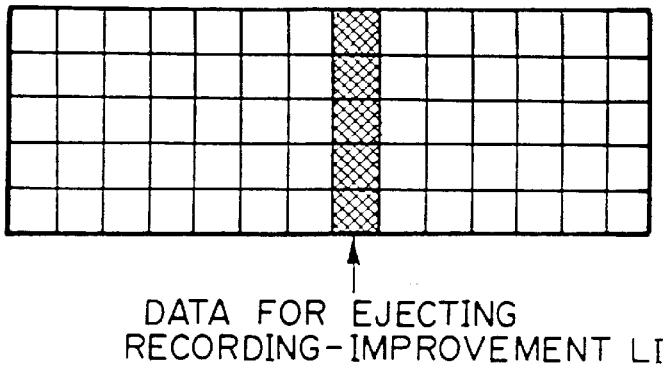

FIGS. 14A and 14B are schematic illustrations of an image with a predetermined pattern of dots on which the recording-improvement liquid is ejected. FIG. 14A is an example of the image, having a black image region and a color image region which are adjacent to each other. Each image region is formed as a matrix of 5×7. FIG. 14B is an example of the pattern of dots on which the recording-improvement liquid is ejected. As shown in FIG. 14B, the recording-improvement liquid is ejected on the color-image's dots being disposed on the side of the boundary (a matrix of 1×7 dots as a meshed portion in the figure). That is, in this figure, the above control part 410 performs the first control mode for driving both the first nozzle group and/or the second nozzle group to record the black image and/or the color image in accordance with the input image data. In this case, also, the control part 410 performs the second control mode for driving the third nozzle group in accordance with the input data, independent to the first mode. The recording-improvement liquid is ejected on the color-image's dots being disposed on the side of the boundary.

In this embodiment, the recording head unit performs the recording only during the period of moving forward in a reciprocating motion. Therefore, the third nozzle group ejects the recording-improvement liquid on a part of the dots to be recorded by the second nozzle group, where the part thereof is adjacent to the boundary line between the black image and the color image. After ejecting the recording-improvement liquid, the second nozzle group starts to perform the recording.

For the purpose of ejecting the recording-improvement liquid, a part of the nozzles 103S*n* corresponding to the color nozzles 103C*n*, 103M*n*, or 103Y*n* of the color image adjacent to the black image is used for the recording-improvement liquid. If a magenta image is adjacent to the black image, for example, a part of nozzles at the position corresponding to the magenta nozzles 103M*n* is used. When the adjacent color image is of a secondary color such as blue, red, and green, a part of the nozzles for ejecting the recording-improvement liquid to be used is correspond to the position of the color nozzles 103C*n*, 103M*n*, or 103Y*n* which eject the ink at first. For example, when the adjacent color image is of green, a part of the nozzles for ejecting the recording-improvement liquid to be used is correspond to the position of the color nozzles 103C*n* which eject the ink at first.

When the ink-jet recording printer of the present embodiment performs the recording during the period that the recording head unit 102 move away form the home position, the recording-improvement liquid is ejected on each dot to be color with the color ink prior to the ejection of that color ink. Consequently, distinct multiple-color image without a spread of the ink in the boundary of colors is obtained because there is no insoluble dyestuff in the color ink regardless of ejecting the color ink on the image adjacent to the black image.

FIGS. 15A–15G are schematic illustrations of an example of forming a color image by using the ink-jet printer of the present embodiment and for explaining the motion of the recording head unit for recording the color image (or with a black image portion). In the figures, reference numeral 103K is a nozzle group for ejecting black ink and is constituted of 160 nozzles. Also, the reference numeral 103C denotes a nozzle group for ejecting color ink and comprises 48 nozzles 139Y*n* for ejecting yellow ink, 48 nozzles for ejecting magenta ink (103M*n*), and 48 nozzles 103C*n* for ejecting cyan ink. These sets of nozzles, 103Y*n*, 103M*n*, and 103C*n* are arranged at intervals of the length equivalent to 8 nozzles. Furthermore, the nozzles 103Y*n* for the yellow ink is disposed at the lower of a feed path of the recording medium, while nozzles 103C*n* is disposed at the upper thereof. In this figure, the recording-improvement liquid can be ejected as the same way as shown in FIGS. 14A and 14B.

Figure 15A:
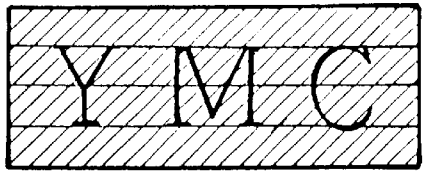
FIGS. 15A–15G are schematic representations of an image to be recorded by an ink-jet recording printer as a preferred embodiment of the ink-jet recording apparatus in accordance with the present invention, and these figures show the steps of forming the images, respectively.

FIG. 15A is the color image having letters "Y", "M", and "C" which are recorded by the yellow, magenta, and cyan ink, respectively, in the black image as a background. It is noted that the black ink is not provided on the dots where the color ink is placed. In the figure, also, there are four horizontal lines in the image. These lines are provided as four parts of the image in which each part corresponds to the image to be recorded by one scanning movement of the recording head in the main-scanning direction.

Figure 15B:
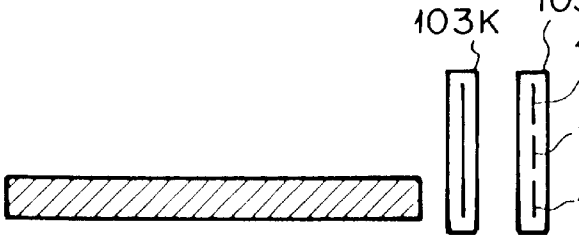

FIG. 15B is a part of the image of FIG. 15A, which is formed by ejecting the black ink from the nozzle group 103K*n*. In this case, 48 nozzles in the lower side of the nozzle group 103K are used. After recording the first part of the image, the recording medium is shifted at a distance corresponding to 48 nozzles.

Figure 15C:
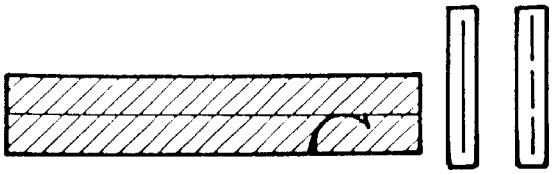

Then the recording head unit records the second part of the image by using both the nozzle group 103*kn* for the black ink and the nozzle group 103C*n* for the cyan ink, as shown in FIG. 15C. The former records the black-color background and the latter records an upper part of the latter "C". After recording the second part of the image, the recording medium is shifted at a distance corresponding to 48 nozzles.

Figure 15D:
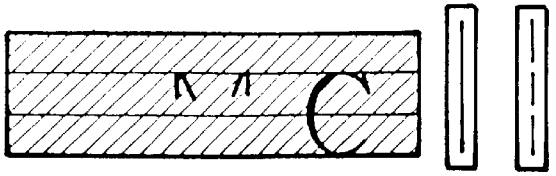

Furthermore, the recording head unit records the third part of the image by using the nozzle group 103K*n* for the black ink, the nozzle group 103C*n* for the cyan ink, and the nozzle group 103M*n* for the magenta ink, as shown in FIG. 15D. That is, the nozzle group 103K*n* records the black-color background, the nozzle group 103C*n* records the rest part (lower part) of the latter "C", and the nozzle group 103M*n* records a part of the latter "M". After recording the third part of the image, the recording medium is shifted at a distance corresponding to 48 nozzles.

Figure 15E:
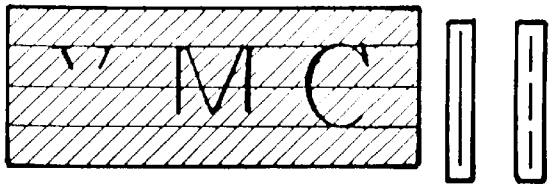
Figure 15F:
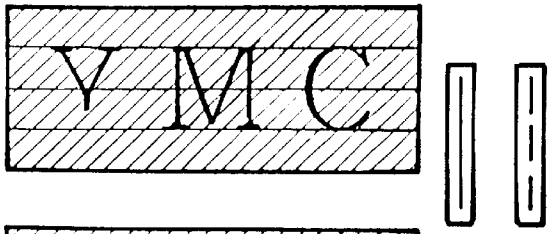
Figure 15G:
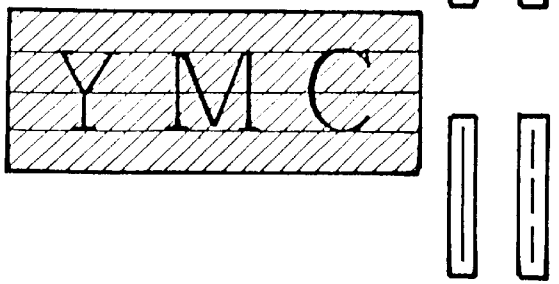

In FIG. 15E, the recording head unit records the fourth part of the image by using the nozzle group 103K*n* for the black ink, the nozzle group 103M*n* for the magenta ink, and the nozzle group 103Y for the yellow ink. That is, the nozzle group 103K*n* records the black-color background, the nozzle group 103M*n* records a part of the latter "M", and the nozzle group 103Y records a part of "Y". Subsequently, as shown in FIG. 15F, the rest of the latter "M" is recorded by the nozzle group 103M*n* and a part of the latter "Y" is recorded by the nozzle group 103Y*n*. Then the recording medium is shifted at a distance corresponding to 48 nozzles.

Before ending the recording movement, the nozzle group 103 Y*n* records the rest of the latter "Y" to complete the whole steps of the recording.

Therefore, the ink-jet printer described above provides with a high-quality image without causing any spread of ink on the boundary area between the black image and the color image by using the ink and the recording-improvement liquid both having the following compositions.

[Composition of the ink]

| | |
|---|---|
| 1. Yellow | |
| Diethylene glycol | 10 parts by weight |
| Isopropyl alcohol | 2 parts by weight |
| Urea | 5 parts by weight |
| Acetylenol EH | 1 parts by weight |
| C.I. direct yellow 86 | 2.5 parts by weight |
| Water | 79.5 parts by weight |
| 2. Magenta | |
| Diethylene glycol | 10 parts by weight |
| Isopropyl alcohol | 2 parts by weight |
| Urea | 5 parts by weight |
| Acetylenol | 1 parts by weight |
| C.I. acid red 289 | 2.5 parts by weight |
| Water | 78.5 parts by weight |
| 3. Cyan | |
| Diethylene glycol | 10 parts by weight |
| Isopropyl alcdhol | 2 parts by weight |
| Urea | 5 parts by weight |
| Acetylenol EH | 1 parts by weight |
| C.I. direct blue 199 | 2.5 parts by weight |
| Water | 79.5 parts by weight |
| 4. Black | |
| Thiodiglycol | 5 parts by weight |
| Glycerin | 5 parts by weight |
| Isopropyl alcohol | 4 parts by weight |
| Urea | 5 parts by weight |

-continued

| | |
|---|---|
| Hood black 2 | 3 parts by weight |
| Water | 78 parts by weight |

[Composition of the recording-improvement liquid]

| | |
|---|---|
| Polyallylamine hydrochloride | 5 parts by weight |
| Benzal conium chloride | 1 parts by weight |
| Diethylene glycol | 10 parts by weight |
| Acetylenol | 0.5 parts by weight |
| Water | 83.5 parts by weight |

Embodiment 9

In this embodiment, the ink-jet printer of Embodiment 8 is used. The printer records the image at the high speed by performing the recording movement of the recording head unit 102 not only in the direction of going away from the home position (forward scanning-motion) but also in the direction of going back to the home position (backward scanning-motion). In addition to the pattern of ejecting the recording-improvement liquid in Embodiment 1, for performing the recording in both directions, the recording-improvement liquid is applied on the black dots adjacent to the boundary between the black image and the color image, as shown in FIG. 16.

Figure 16:
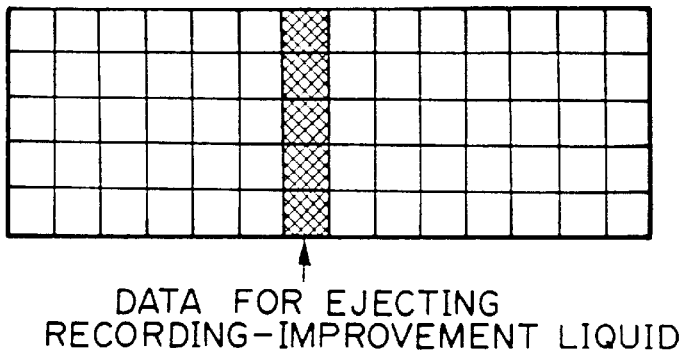
FIG. 16 is a schematic representation of a pattern of placing droplets of the recording-improvement liquid with respect to the image in Embodiment 9.

FIG. 16 is the pattern of dots which receives the recording-improvement liquid for forming the same image as that of FIG. 14A.

At the forward scanning motion, the recording-improvement liquid is ejected by using the same data as that of Embodiment 1 as shown in FIG. 14B prior to record the color image. At the backward scanning motion, furthermore, the recording-improvement liquid is ejected by using the data with respect to the pattern shown in FIG. 16 prior to record the black image. Consequently, the ink-jet printer of this embodiment records the image at a higher speed compared with that of Embodiment 8. Because it performs the recording movement of the recording head unit not only in the direction of going away from the home position but also in the direction of going back to the home position. The printer records the image at the high speed.

Prior to eject the black ink, by the way, the recording-improvement liquid can be ejected from a part of the nozzles for ejecting the recording-improvement liquid, which is positioned at the same level as that of the nozzles for ejecting the black ink.

Example 10

Figure 17:
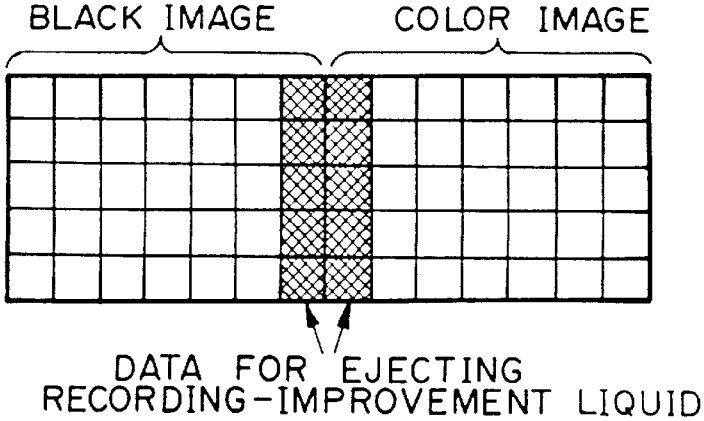
FIG. 17 is a schematic representation of a pattern of placing droplets of the recording-improvement liquid with respect to the image in Embodiment 10.

In the above ninth embodiment, the recording head unit ejects the recording-improvement liquid only on the dots corresponding to the black image during the period of the forward scanning-motion. Also, the recording head unit ejects the of recording-improvement liquid only on the dots corresponding to the color image during the period of the backward scanning-motion. In this embodiment, on the other hand, the recording-improvement liquid is ejected on both images during both periods, as shown in FIG. 17.

During the period of the forward movement, therefore, the recording-improvement liquid is ejected on the dots corresponding to the color image prior to eject the color ink, while the recording-improvement liquid is ejected on the dots corresponding to the black image after ejecting the black ink thereon. During the period of the backward movement, on the other hand , the recording-improvement liquid is ejected on the dots corresponding to the black image prior to eject the black ink, while the recording-improvement liquid is ejected on the dots corresponding to the color image after ejecting the color ink thereon.

Comparing with Embodiments 7 and 8, as a result, a higher-quality image without causing a spread of ink can be obtained by ejecting the recording-improvement liquid on both adjacent portions of black and color images.

In Embodiments 7 and 8, the recording-improvement liquid is ejected on only one dot in width of the boundary area of each images adjacent to each other. In this embodiment, on the other hand, the recording-improvement liquid is ejected on more than one dot in width of the boundary area of each images adjacent to each other, as shown in FIG. 17, for preventing a spread of the ink on the boundary, more perfectly.

Furthermore, in addition to Embodiments 8 and 9, a water-resistibility of the image can be more improved by ejecting the recording-improvement liquid on the non-boundary area of the image as shown in FIG. 18.

Figure 18A:
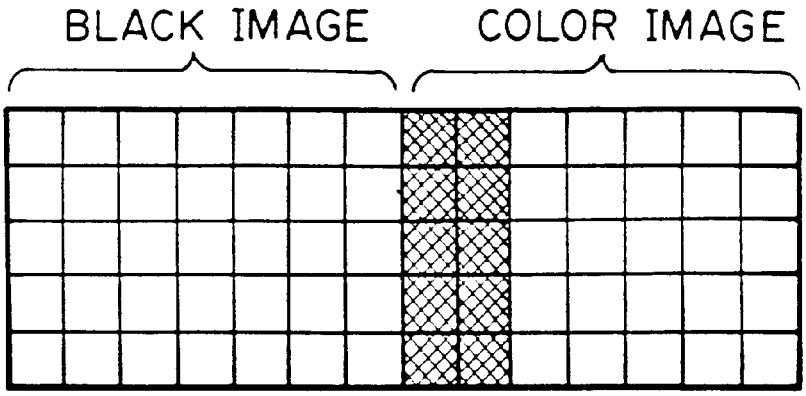
FIGS. 18A–18C are schematic representations of patterns of placing droplets of another recording-improvement liquid with respect to the image.
Figure 18B:
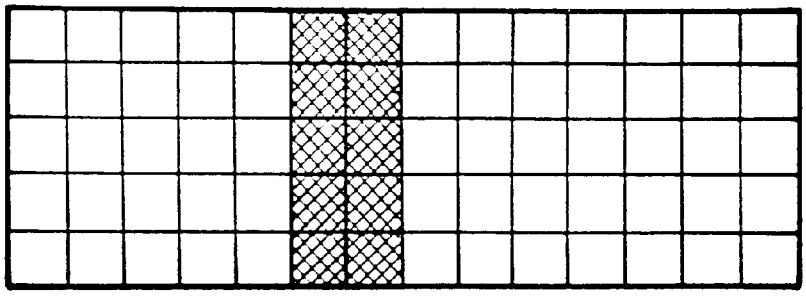
Figure 18C:
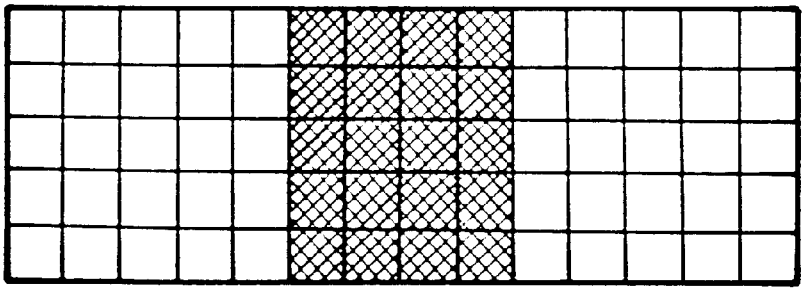

In FIGS. 18A–18C show different patterns of the dots where the recording-improvement liquid is applied.

That is, the image of FIG. 18A receives the recording-improvement liquid on two dots in width of the color image, adjacent to the boundary. The image of FIG. 18B receives the recording-improvement liquid on two dots in width of the black image, adjacent to the boundary. Furthermore, the image of FIG. 18C receives the recording-improvement liquid on two dots in width of the black image and two dots in width of the color image, both adjacent to the boundary.

Embodiment 11

In this embodiment, the following color ink compositions are used instead of the color used in Embodiments 8–10.

| | |
|---|---|
| 1. Yellow | |
| Glycerin | 5.0 parts by weight |
| Thiodiglycol | 5.0 parts by weight |
| Urea | 5.0 parts by weight |
| Isopropyl alcohol | 4.0 parts by weight |
| C.I. direct yellow 142 | 2.0 parts by weight |
| Water | 79.0 parts by weight |
| 2. Magenta | |
| Glycerin | 5.0 parts by weight |
| Thiodiglycol | 5.0 parts by weight |
| Urea | 5.0 parts by weight |
| Isopropyl alcohol | 4.0 parts by weight |
| C.I. acid red | 2.0 parts by weight |
| Water | 79.0 parts by weight |
| 3. Cyan | |
| Glycerin | 5.0 parts by weight |
| Thiodiglycol | 5.0 parts by weight |
| Urea | 5.0 parts by weight |
| Isopropyl alcohol | 4.0 parts by weight |
| C.I. direct blue 199 | 2.5 parts by weight |
| Water | 78.5 parts by weight |

The above color inks are of a low ability of permeating through the recording medium compared with that of the color inks used in Embodiments 8–10. In addition, they have high coloring properties, and also they are hard to be feathered. On the other hand, these color inks are easily diffused on the boundary between the images thereof.

In this embodiment, therefore, when a color image is adjacent to another color image or a black image, the recording-improvement liquid may be only ejected on a color-image side of the boundary between the images as shown in FIG. 15. Thus the image having a comparatively low diffusion of the ink can be obtained regardless of using the ink having an inclination to diffuse on the boundary between different colors formed on the recording medium. In this case, it is preferable to perform the recording movement during the period of moving the recording heads forward in the same way as that of the first embodiment.

Secondary, as shown in FIG. 16, the high-quality image and the high-speed recording can be simultaneously realized by ejecting the recording-improvement liquid on the black-image's side of the boundary area to perform the recording during the period of moving the recording head unit backward in addition to move the unit forward.

Furthermore, the higher-quality image can be obtained by ejecting the recording-improvement liquid on both sides of the boundary between the black image and the color image as shown in FIG. 17.

In addition to the above description, as shown in FIGS. 18A–18C, a further improved image quality can be achieved by expanding a size of the region where the recording-improvement liquid is applied.

Figure 19A:
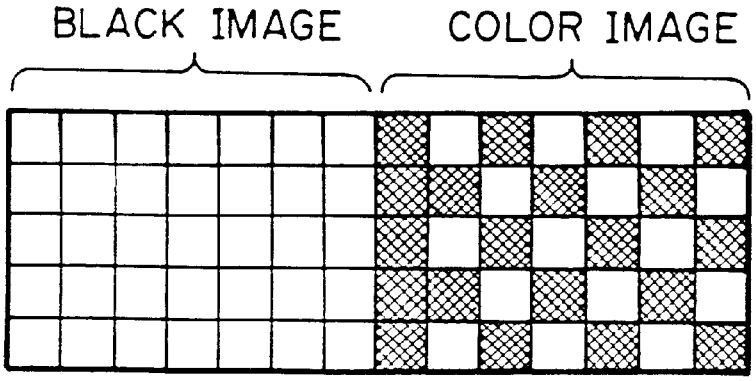
FIGS. 19A–19C are schematic representations of patterns of placing droplets of another recording-improvement liquid with respect to the image.
Figure 19B:
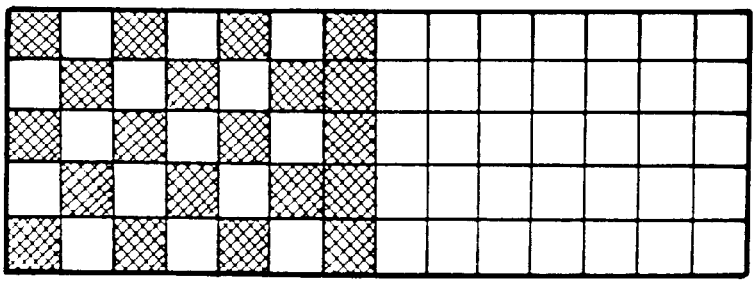
Figure 19C:
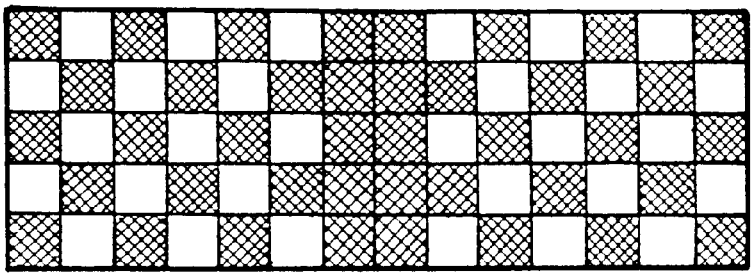

Needless to say, as shown in FIGS. 19A–19C, the image having improved properties of water-resistant can be obtained by ejecting the recording-improvement liquid on other regions in addition to the boundary area.

FIGS. 19A–19C are schematic representations of an image consisting of black image portion and a color image portion. In the figure, each dot with the recording-improvement liquid is indicated by a meshed square. In FIG. 19A, only the color image portion comprises a checkered pattern of dots on which the recording-improvement liquid is ejected. In stead of ejecting that liquid on the color image portion, FIG. 19B shows the black image portion comprises a checkered pattern of dots on which the recording-improvement liquid is ejected. In the case of FIG. 19C, furthermore, each image portion comprises a checkered pattern of dots on which the recording-improvement liquid is ejected.

Embodiment 12

Figure 20:
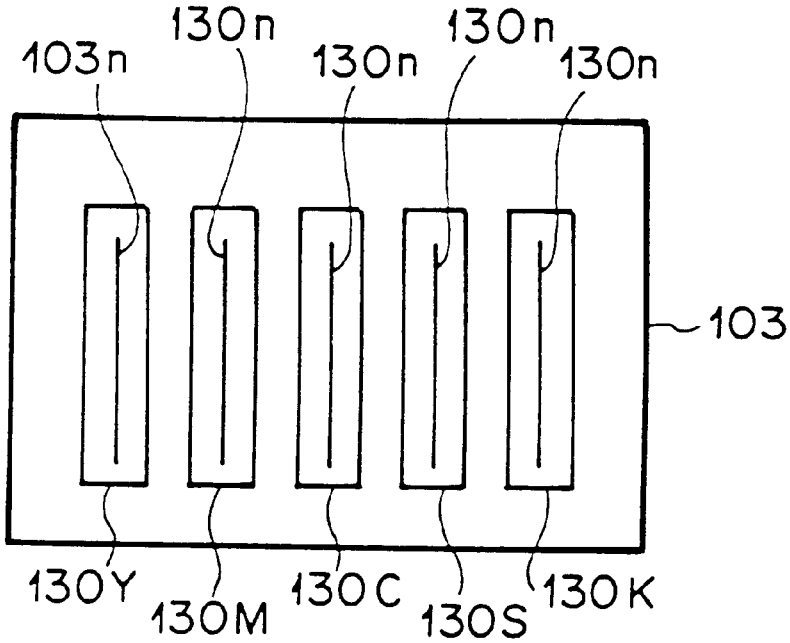
FIG. 20 is a front view of an ink-jet recording head unit to be mounted on the ink-jet recording printer as a preferred embodiment of the present invention, for illustrating groups of nozzles formed on the recording head unit.

FIG. 20 is a schematic plane view of an ink-jet recording head with a different arrangement of the nozzle groups compared with that of Embodiments 8–11, for explaining such arrangement on a surface of the head to be faced with the recording medium.

The ink-jet recording head comprises a nozzle group 130K for ejecting a black ink, a nozzle group for ejecting a cyan ink 130C, a nozzle group 130Y for ejecting a yellow ink, and a nozzle group 130S for ejecting the recording-improvement liquid. Furthermore, the nozzle group 130S is disposed between the nozzle group 130K and the nozzle group 130C.

Each nozzle group comprises 128 nozzles and the volume of ink to be ejected from each nozzle is approximately 80 ng for each of the black-ink nozzles 103k*n*, and approximately 40 ng for each of the other nozzles 130C, 130M, 130Y, and 130S of cyan, magenta, yellow, and the recording-improvement liquid, respectively.

Comparing with the recording head shown in FIG. 12, the recording head of the present embodiment comprises more nozzles, so that dimensions of the recording head can be increased. In accordance with the present embodiment, however, the high speed printing can be attained because each color ink and the recording-improvement liquid can be ejected on the same position at one scanning movement.

The case of interest here is that the treatment described in one of Embodiments 1–4 may be applied in the above recording head to pretend a spread of the ink on the boundary area between the black image portion and the color image portion or between the different color image portions.

By the way, the recording head of the present embodiment is able to perform the recording movement of the recording head unit at the high speed, so that it often causes a spread of ink on the above boundary area. When a black image portion is adjacent to a red image portion, for example, the printer of FIG. 12 performs different scanning movements for recording the black image portion, a magenta image that forms the red image portion, and the yellow image portion, respectively. In the present embodiment, on the other hand, the recording head records each color image by the same scanning movement. Therefore, the problem of often causing a spread of ink on the above boundary area can be solved by extending the region on which the recording-improvement liquid is ejected.

Embodiment 13

In Embodiments 8–12, the examples of changing the region on which the recording-improvement liquid is ejected. However, it may be possible to change the amount of the recording-improvement liquid to be ejected in stead of changing the region.

Figure 21A:
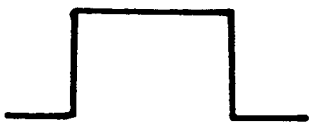
FIGS. 21A and 21B are graphical representations of ejection pulses generated from the ink-jet recording head unit to be mounted on the ink-jet recording printer as a preferred embodiment of the present invention.
Figure 21B:
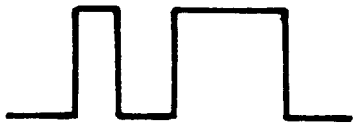

In the latter case, when the region to be treated with the above liquid is restricted in the boundary area as shown in FIGS. 14A–14B, FIGS. 15A–15D, FIGS. 16–17, and FIGS. 18A–18C, it may be preferable to increase the amount of ejecting the recording-improvement liquid on each dot by performing a heat control of the nozzles responsible for ejecting the liquid, or by changing the pulse width to be applied on each heating means disposed in the nozzles for ejecting the liquid. In the former case, to put it concretely, a temperature of the nozzles for ejecting ink is adjusted to 25° C., for example, while a temperature of the nozzles for ejecting the recording-improvement liquid is adjusted to 35° C. In the latter case, furthermore, the nozzles for ejecting ink receives a single pulsed signal as shown in FIG. 21A for example, while the nozzles for ejecting the above liquid receives a double pulsed signal as shown in FIG. 21B.

As another illustration of the step for changing the amount of the recording-improvement liquid to be ejected we may consider another construction of the recording head.

Furthermore, as shown in FIGS. 19A–19C, it may be possible to divide one scanning movement of the recording head for ejecting the recording-improvement liquid into two times, i.e., the first is for ejecting on the boundary area and the second is for ejecting on the other region. Therefore, the boundary area receives a great amount of the recording-improvement liquid compared with the non-boundary area.

In each of Embodiments 8–13 described above, the recording movement is illustrated in that black is defined as the first color. However, it is also possible to use another color, for example blue or red is defined as the first color in the case of using only these two colors.

Figure 22A:
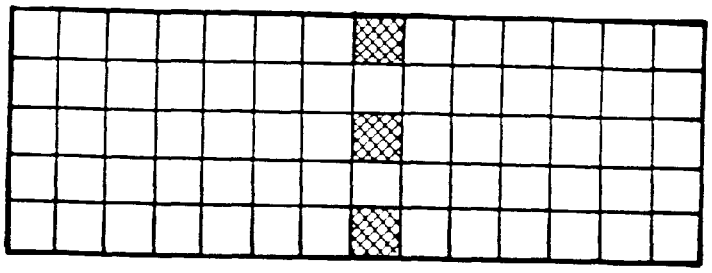
FIGS. 22A–22E are schematic representations of patterns of placing droplets of the recording-improvement liquid with respect to the image in other embodiments.
Figure 22B:
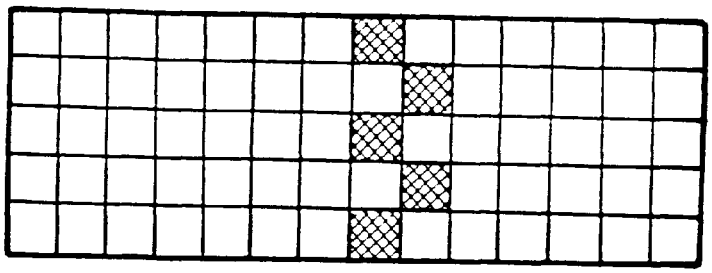

It is not limited to use the data for ejecting the recording-improvement liquid as that of Embodiments 1–6. For example, it is possible to thin-down the number of the dots on which the recording medium is applied, so as to form a predetermined pattern or a random pattern of the image data on the boundary area as shown in FIGS. 22A–22B. These patterns may be suitably selected in accordance with the characteristics of the ink, the recording-improvement liquid, and the recording medium; or the performance of the printer, such as a recording speed or the like.

Figure 22C:
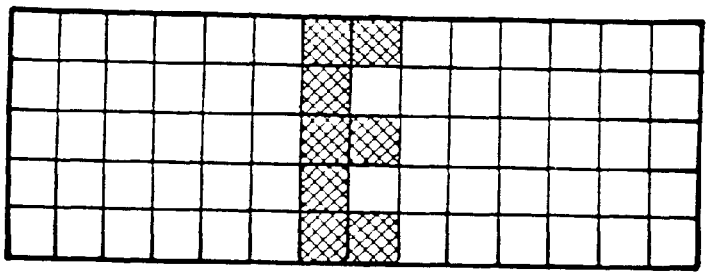
Figure 22D:
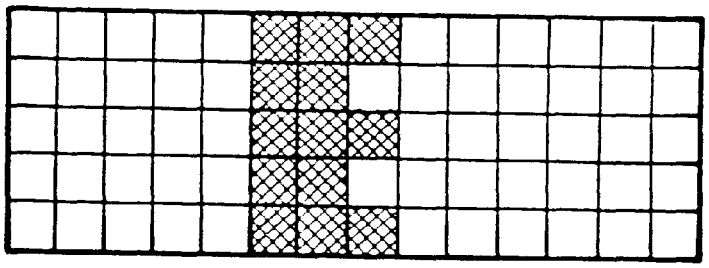

Furthermore, as shown in FIGS. 22C–22D, it may be possible to thin down the number of the dots on the color-image's side instead of thinning on the black-image's side, or thin down the number of the dots on the black-image's side.

Figure 22E:
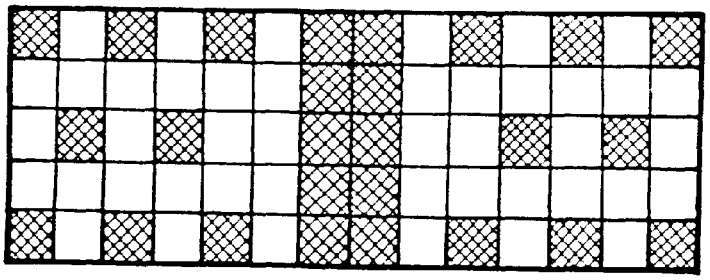

In the case of ejecting the recording-improvement liquid on the non-boundary area, it may be also not limited in the ejecting pattern shown in FIG. 1 but also possible to use the ejecting pattern shown in for example FIG. 22E, or its reversed pattern.

The process of preparing the recording-improvement liquid is not limited to that of the above embodiments. It may be also possible to prepare the recording-improvement liquid as follows.

That is, first of all, the following ingredients are mixed. Then the mixture is filtrated through a membrane filter of 0.22 $\mu$m in pore size (trade name: Floropore filter, Sumitomo Denko Co., LTD.). A filtrate liquid is adjusted to pH 4.8 by adding NaOH to obtain a recording-improvement liquid Al.

[Composition of A1]

a low molecular ingredient of a cationic compound stearyl trimethyl ammonium chloride (trade name: Electrostopper QE, manufactured by Kao Co., LTD.) 2.0 parts by weight a high molecular ingredient of a cationic compound polyamine sulfone (average molecular weight: 5,000) (trade name: PAS-92, manufactured by Nitto Boseki, Co., LTD.) 3.0 parts by weight

| | |
|---|---|
| thiodigiycol | 10 parts by weight |
| water | 85 parts by weight |

Also, the ink to being insoluble by mixing with the above recording-improvement liquid is preferably prepared by the following steps and contains the following ingredients. That is, yellow ink Y1, magenta ink M1, cyan ink C1, and black ink K1 are obtained, respectively, by the process comprising the steps of: mixing the following ingredients; and filtrating the mixture through a membrane filter (trade name: Chrolopore filter, Sumitomo Denko, Co., LTD) of 0.22 $\mu$m in pore size under pressure.

Y1

| | |
|---|---|
| C.I Direct yellow 142 | 2 parts by weight |
| Thiodiglycol. | 10 parts by weight |
| Acetylenol EH (Kawaken fine-chemical, Co., LTD.) | 0.05 parts by weight |
| Water | 97.95 parts by weight |

M1

M1 is prepared from the same ingredients except that 2.5 parts by weight of acid red 289 is used as a dyestuff instead of C.I Direct yellow 142 and also the water content is of 97.45 parts by weight.

C1

C1 is prepared from the same ingredients except that 2.5 parts by weight of acid blue 9 is used as the dyestuff instead of C.I Direct yellow 142 and also the water content is of 97.45 parts by weight.

K1

K1 is prepared from the same ingredients except that 3 parts by weight of hood black 2 is used as the dyestuff instead of C.I Direct yellow 142 and also the water content is of 96.95 parts by weight.

The recording-improvement liquid and the ink, both having one of the above compositions (aqueous compositions), are mixed with each other at a certain inner or surface position of the recording medium as a result of their permeation therethrough. In the mixture, as a first stage of the reaction, the low molecular ingredient or the cationic oligomer of the cationic substance is associated with the anionic compound used in a pigment ink or with a water-soluble dye having an anionic group used in an ink. The moment they associated, a phase separation is occurred and results in an aggregation of the pigments or dyestuff by means a dispersion-breakdown caused in the ink or the pigment ink.

As a second stage of the reaction, an aggregate of the dyestuff or the pigments generated as a result of the above association becomes larger by adsorbing the aggregate on the surface of the high molecular ingredient being included in the recording-improvement liquid. Consequently, it becomes to difficult to introduce the aggregate into the space formed among fibers of the recording medium, while an aqueous part of the mixture without a solid part is able to permeate through the according medium. Accordingly, the high recording quality and the stable fixation can be consistent with each other.

Furthermore, the above aggregate becomes highly viscous, so that the aggregate cannot pass through the recording medium in company with the aqueous medium. Regardless of arranging the different color-ink dots so as to being adjacent to each other, as in the case of a multiple-color image formation, there is no mixing and bleeding between these different ink dots. In this case, furthermore, a light-fastness of the image can be also improved by forming the image with a screening effect of the polymer.

By the way, the term "insoluble" or "aggregation", means the observable events in only the above first step or in both the first and second steps.

For carrying out the present invention, furthermore, there is no need to use a high-molecular cationic substance and a polyvalent metal salt. Alternatively, the amount of using these substances can be kept at the minimum when there is need to use them. Because they are only used as secondary substances for further improving an effects of the present invention. As a result, we are able to give another effect of the present invention in that the present invention enables to prevent a lowering of coloring properties of the dyestuff. The lower coloring properties of the dyestuff is a problem to be caused by using the high-molecular cationic substance and the polyvalent metal salt for obtaining an effect of water-resistant in the conventional method.

The recording medium to be used for carrying out the present invention is not limited to a certain medium. It can be preferably selected from any kinds of normal paper, such as copy paper, bond paper, and so on, which have been used in the conventional recording process. It is noted that coated paper prepared especially for the ink-jet recording and transparent paper for a overhead projector can be also applied as the recording medium of the present invention. Furthermore, general wood-free paper and glossy paper are preferably used in the present invention.

Embodiment 14

In the second embodiment described above, the whole boundary area is treated with the recording-improvement liquid without thinning-down while the non-boundary area is not treated with the recording-improvement liquid. In this case, a color difference between these regions is significantly large so that the image is, as it are, fringed around the image. Accordingly, the present embodiment is constructed so as not to attract attention on the above edge as shown in FIGS. 23A–23F.

Figure 23A:
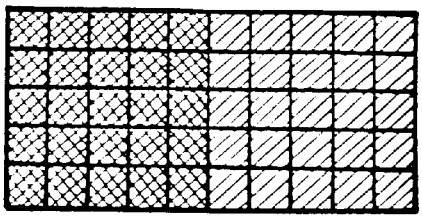
FIGS. 23A–23F are schematic representations of an image for illustrating an ink-jet recording method in accordance with the present invention, where

FIG. 23A shows an image of having a black-image portion and a yellow-image portion, where each portion is formed as a matrix of 5×5 dots. FIGS. 23B–23F are examples of a pattern of ejecting droplets of the recording-improvement liquid.

Figure 23B:
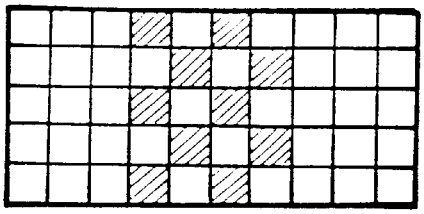

In FIG. 23B, a boundary area between the above two color-image portion takes two dots in width of each portion. The boundary area is formed as a checkered pattern of dots formed by ejecting the recording-improvement liquid. In this embodiment, different types of dots are formed in which one receives both the ink and the recording-improvement liquid so as to change its color while the other receives only the ink. The color difference between the above regions is minimized so as not to attract attention on the above edge.

Figure 23C:
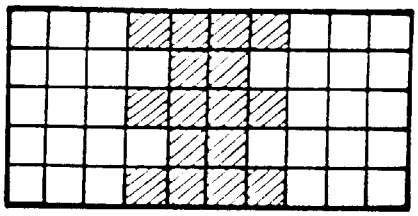
Figure 23D:
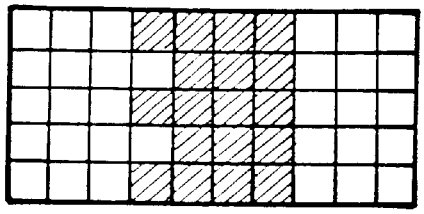

In FIG. 23C, the recording-improvement liquid is ejected so as to form a stepwise reduction of the amount thereof. In this figure, also, the boundary area between the black- and yellow-color images takes two dots in width of each image so as to form two vertical lines of the dots. That is, one dot line (inner dot line) is adjacent to a different-color dot line and another dot line (outer dot line) is adjacent to a non-boundary area. The inner dot line receives the recording-improvement liquid without performing the process of thinning-down, while the outer dot line receives the recording-improvement liquid after thinning the number of the dots down in a manner that the recording-improvement liquid is applied on every other dot. In this case, furthermore, the non-boundary area does not receive the recording-improvement liquid.

It is noted that the pattern of ejecting the recording-improvement liquid for each color can be variable, for example changing the patterns between the black and the yellow.

By the way, an appearance of the black dot with the recording-improvement liquid is different from that of one without the recording-improvement liquid. In the case of yellow, on the other hand, there is no difference between the one with the recording-improvement liquid and the other without recording-improvement liquid. Therefore, a pattern of the dots that receive the recording-improvement liquid is shown in FIG. 23A.

Figure 23E:
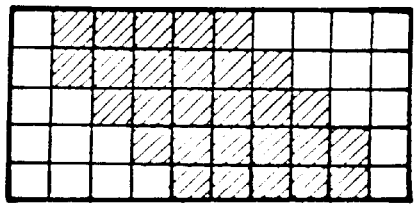

In addition, as described above, the recording-improvement liquid is ejected so as to form the stepwise reduction (i.e., including two stages) of the amount thereof. However, the number of stages is not limited to two. It is possible to make three or four stages in the above stepwise reduction. For example, FIG. 23E shows a pattern of the dots that receive the recording-improvement liquid with a four-stage reduction. The whole dots adjacent the boundary line receive the recording-improvement liquid without performing any thinning-down process. The amount of the recording-improvement liquid is stepwisely decreased along a outward direction. Therefore, there is no difference between the boundary area and the non-boundary area at their boundary line.

Figure 23F:
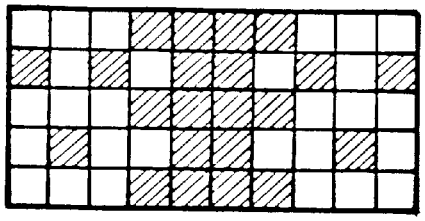

Furthermore, it is also possible to strike the recording-improvement liquid on the non-boundary area. In this case, an image having water-resistibility can be obtained. For example, a pattern of the dots that receive the recording-improvement liquid is shown in FIG. 23F.

In this embodiment, the image has black and yellow portions but not limited to. The image having black and other principle colors (Magenta, Cyan, and Magenta) are also possible to obtain the similar effects.

Embodiment 15

The above embodiments, there three types of the way of striking the recording-improvement liquid on the recording medium. In a first type, that is, the recording-improvement liquid is stroked only on the boundary area. In a second type, the boundary area receives the recording-improvement liquid without performing the process of thinning-down, while the non-boundary area receives the recording-improvement liquid with performing the process of thinning-down. In this embodiment, furthermore, two other ways of striking the recording-improvement liquid on the recording medium are selectively used, for example as shown in FIGS. 24A–24E.

Figure 24A:
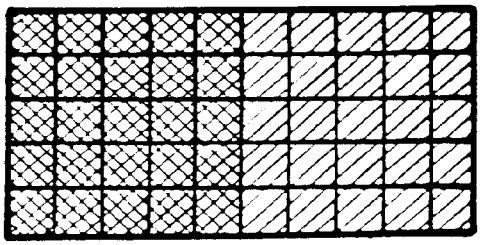
FIGS. 24A–24E are schematic representations of an image for illustrating an ink-jet recording method in accordance with the present invention, where

FIG. 24A shows an image having an image portion of color A and an image portion of color B, in which each formed as a matrix of 5 by 5 dots. These two dots are adjacent to each other.

Figure 24B:
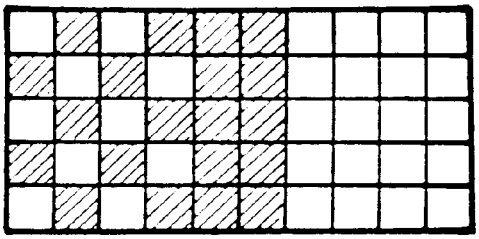

FIG. 24B shows a pattern of dots that receive the recording-improvement liquid for the image of FIG. 24A. In this figure, the number of the dots to be treated with the recording-improvement liquid is not thinning down on the boundary between the A and B images. In the non-boundary portion, the side of color A image portion receives a recording-improvement liquid after the process of thinning down as a checkered pattern while the side of color B does not receive the recording-improvement liquid.

This kind of the method is more effective when the color A ink is in the type of having a low permeability while the color B ink is in the type of having a high permeability. By adding a surface active agent in the ink, in general, its surface tensity becomes low while its permeability becomes high. In addition, the ink in the type of having a low permeability and a high surface tensity tends to prevent a spread of ink along fibers of the recording medium (i.e., feathering phenomenon) to make a clear boundary between a printed portion and a non-printed portion. On the other hand, the ink having a high permeability tends to cause feathering but not bleeding.

When the low-permeability ink comes into contact with the high-permeability ink or the recording-improvement liquid on the recording medium, the surface active agent in the latter ink tends to pass into a boundary portion of the contact, resulting that an unequal distribution of the surface active agent is observed in a part of the contact. In this case, therefore, a part of the ink having a high surface tensity and a low permeability becomes of a high permeability. In this kind of the ink, the part having a low surface intensity and a high permeability permeates quickly into the recording medium with the other part having a low permeability permeates slowly, resulting that a portion of the latter remains on a surface of the recording medium and directs toward a center of ink droplet. Thus a concentration of the ink in the boundary of the above contact becomes low result in a whitening in the above boundary to cause an extremely low image-quality.

When the ink does not have the properties of water-resistant, by the way, the recording-improvement liquid may be only stroked on the boundary between different colors to decrease the consumption of the recording-improvement liquid for cutting the running expenses. When the ink having a low permeability for improving the quality of image is used, however, the above phenomenon might be occurred by only striking the recording-improvement liquid on the boundary of different colors. This kind of the phenomenon may be occurred on two different boundary portions, i.e., one between the color A ink having a low permeability and the color B ink having a high permeability and the other between a part of the color A image region with the recording-improvement liquid and another part of thereof without recording-improvement liquid. Therefore, when the recording-improvement liquid is only stroked on its boundary side against the color B, a portion with the recording-improvement liquid and another portion with out the recording-improvement liquid can be observed. To solve this problem, it becomes necessary to strike the recording-improvement liquid on the whole image.

Figure 24C:
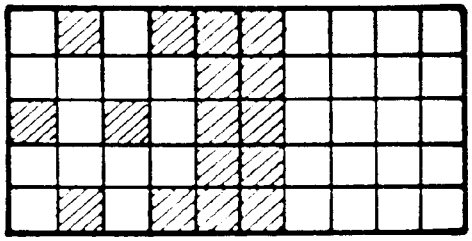

It is noted that there is no need to strike the recording-improvement liquid on the whole color A image portion without thinning down. In the above embodiments, the recording-improvement liquid is stroked on the boundary between the A and B colors without performing the process of thinning down for preventing an occurrence of the breeding. According to the present embodiment, however, the amount of the recording-improvement liquid to be stroked is determined so as to enoughly prevent a disorder of the ink concentration to be caused by a drastic change in the distribution of surface active agent. The amount of the recording-improvement liquid to be stroked on the non-boundary portion can be determined by the types of ink and recording-improvement liquid. In FIG. 25B, it is only ½ with respect to the mount of ink. However, it is not limited to that amount but also limited to approximately ¼ and ⅛. In FIG. 24C, for example, the amount of the recording-improvement liquid is of ¼ with respect to the ink.

By the way, the black ink to be used in the image formation of characters may be preferably in the type of having a low permeability (color A ink) to improve the quality of ink image. Furthermore, color inks except black may be preferably in the type of having a high permeability to prevent the breeding and to fix the image in stable (color B ink). In this kind of combination, it is more effective to use the method of the present embodiment on the boundary between the black and another color. In the case of using the color (except black) ink with a low permeability, as described in above, the recording-improvement liquid should be stroked on the non-boundary area.

Furthermore, the breading can be more effectively prevented by striking the recording-improvement liquid on the boundary area in two or more dots width without performing the process of thinning down.

Figure 24D:
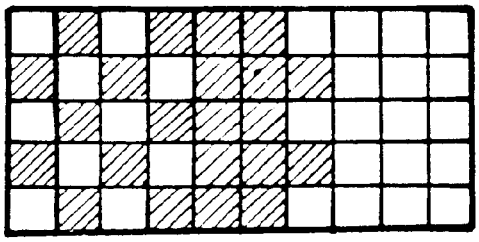

In the case that a frame of the color B image region is remarkable as a result of in the presence or absence of the recording-improvement liquid, it may be possible to thin down the number of dots where the recording-improvement liquid is stroked, stepwisely, as shown in FIG. 24D. By the way, a pattern of thinning down in the non-boundary portion is not limited to the present invention.

Figure 24E:
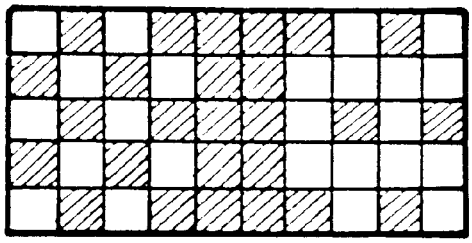

The patterns of dots on which the recording-improvement liquid is provided are able to prevent a disorder of the image portion on the boundary between different colors. In this case, however, it is difficult to obtain its water-resistibility on the non-boundary area of color B. In the case of providing a gold color image with water-resistibility, the recording-improvement liquid may be also stroked on the non-boundary area of color B with the process of thinning down at an a preferable ratio as shown in FIG. 24E. In this figure, the amount of the recording-improvement liquid to be provided on the color B image portion is of ¼ with respect to the ink. Furthermore, a pattern of striking the recording-improvement liquid cannot be limited to that in the figure, a sufficient amount of the recording-improvement liquid may be determined for keeping a water-resistibility of the image which can be determined by a combination of the ink and the recording-improvement liquid.

[Others]

The present invention achieves distinct effect when applied to a recording head or a recording apparatus which has means for generating thermal energy such as electrothermal transducers or laser light, and which causes changes in the ink by the thermal energy so as to eject ink. This is because such a apparatus can achieve a high density and high reliquid recording.

A typical structure and operational principle thereof is disclosed in U.S. Pat. Nos. 4,723,129 and 4,740,796, and it is preferable to use this basic principle to implement such a apparatus. Although this apparatus can be applied either to on-demand type or continuous type ink-jet recording apparatus, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy correspondent to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the thermoelectric transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery apparatus, or a preliminary auxiliary apparatus for a recording head as a constituent of the recording apparatus because they serve to make the effect of the present invention more reliable. As examples of the recovery apparatus, are a capping means and a cleaning means for the recording head, and a pressure or suction means for the recording head. As examples of the preliminary auxiliary apparatus, are a preliminary heating means utilizing electrothermal transducers or a combination of other heater elements and the electrothermal transducers, and a means for carrying out preliminary ejection of ink independently of the ejection for recording. These apparatuss are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multiple-color and full-color modes. Here, the monochromatic mode performs recording by using only one major color such as black. The multiple-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink-jet apparatus, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink-jet recording apparatus of the present invention can be employed not only as an image output terminal of an information processing device such as a computer, but also as an output device of a copying machine including a reader and as an output device of a facsimile apparatus having a transmission and receiving function.

Figure 25:
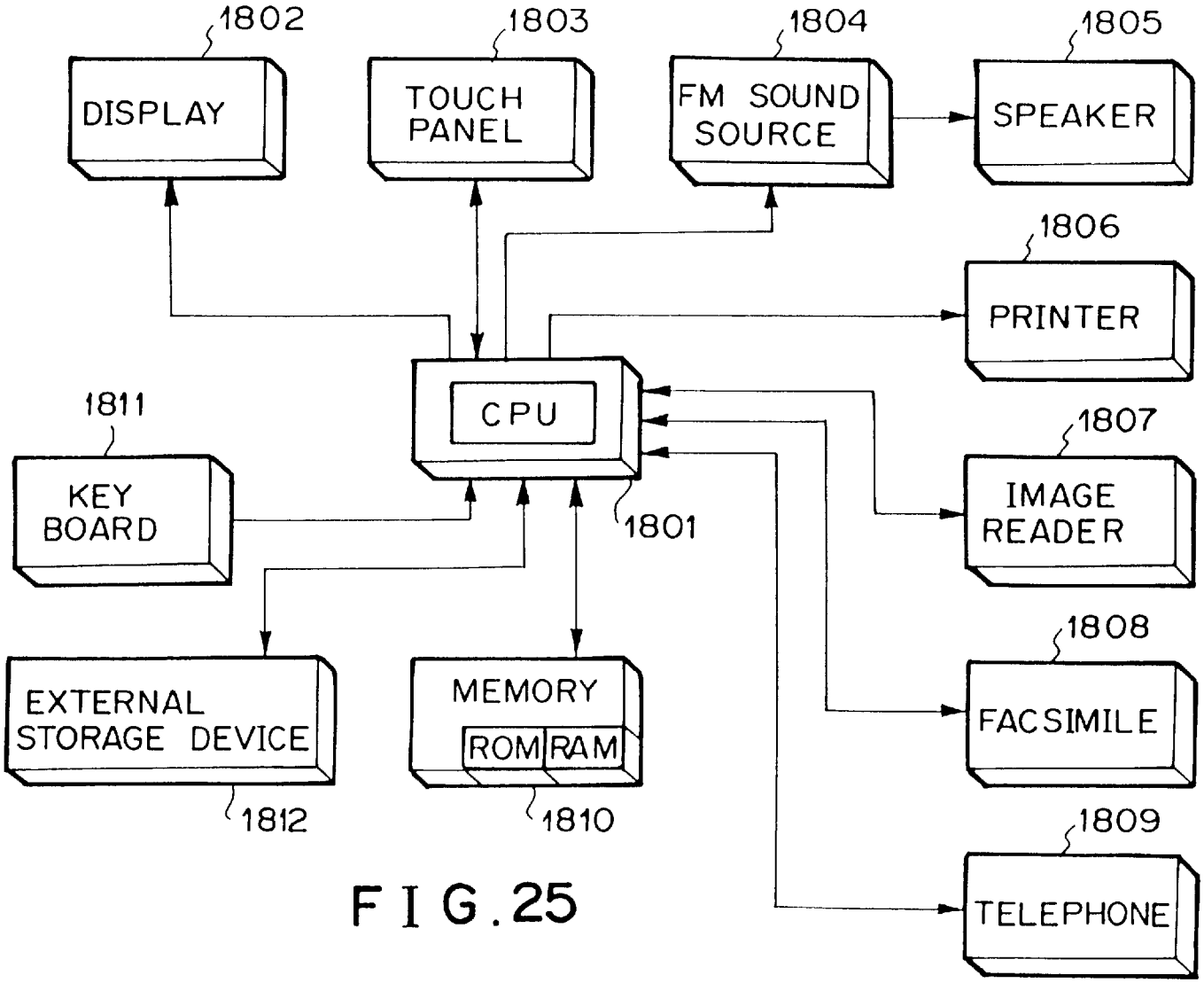
FIG. 25 is a block diagram for illustrating a preferred embodiment of an information-processing apparatus using an ink-jet recording printer of the present invention as an output means.

FIG. 25 is a block diagram showing general construction of an information processing apparatus having a function of wordprocessor, personal computer, facsimile machine, a copy machine and so forth, to which the printing apparatus according to the present invention is applied.

In the drawings, a reference numeral 1801 denotes a control portion performing control of the overall apparatus, which includes CPU, such as microprocessor and so forth, and various I/O port, to perform control for outputting control signal or data signal and so forth to respective portions and inputting control signal or data signal from the respective portions. A reference numeral 1802 denotes a display portion having a display screen, on which various menu, document information and image or so forth read by an image reader 1807 are displayed. A reference numeral 1803 denotes a transparent pressure sensitive touch panel provided on the display portion 1802 for performing item entry or coordinate portion entry on the display portion 1802 by depressing the surface thereof by a finger or so forth.

A reference numeral 1804 denotes a FM (frequency modulation) sound source portion which stores music information produced by a music editor and so forth in a memory portion 1810 or an external memory 1812 and performs FM modulation by reading out the stored music information from the memory portion or so forth. An electric signal from the FM sound source portion 1804 is transformed into an audible sound by a speaker portion 1805. A printer portion 1806 is employed as an output terminal of the wordprocessor, the personal computer, the facsimile machine, the copy machine and so forth, in which the printing apparatus according to the present invention is applied.

A reference numeral 1807 denotes an image reader portion for optoelectrically read out an original data for inputting, which is located at the intermediate position in an original feeding path and performs reading out various original document, such as original document for facsimile machine or copy machine. A reference numeral 1808 denotes a facsimile (FAX) transmission and reception portion for transmitting original data read by the image reader portion or for receiving transmitted facsimile signal, which facsimile transmission and reception portion has an external interface function. A reference numeral 1809 denotes a telephone machine portion having a normal telephone function and various associated functions, such as a recording telephone and so forth.

A reference numeral 1810 denotes a memory portion including a ROM storing a system program, a manager program, other application program and so forth, as well as character fonts, dictionary and so forth, a RAM for storing application program loaded from an external storage device 1812, document information, video information and so forth.

A reference numeral 1811 denotes a keyboard portion inputting document information or various commands. A reference numeral 1812 denotes the external storage device employing a floppy disc or hard disc drive as storage medium. In the external storage device 1812, document information, music or speech information, application program of the user and so forth are stored.

Figure 26:
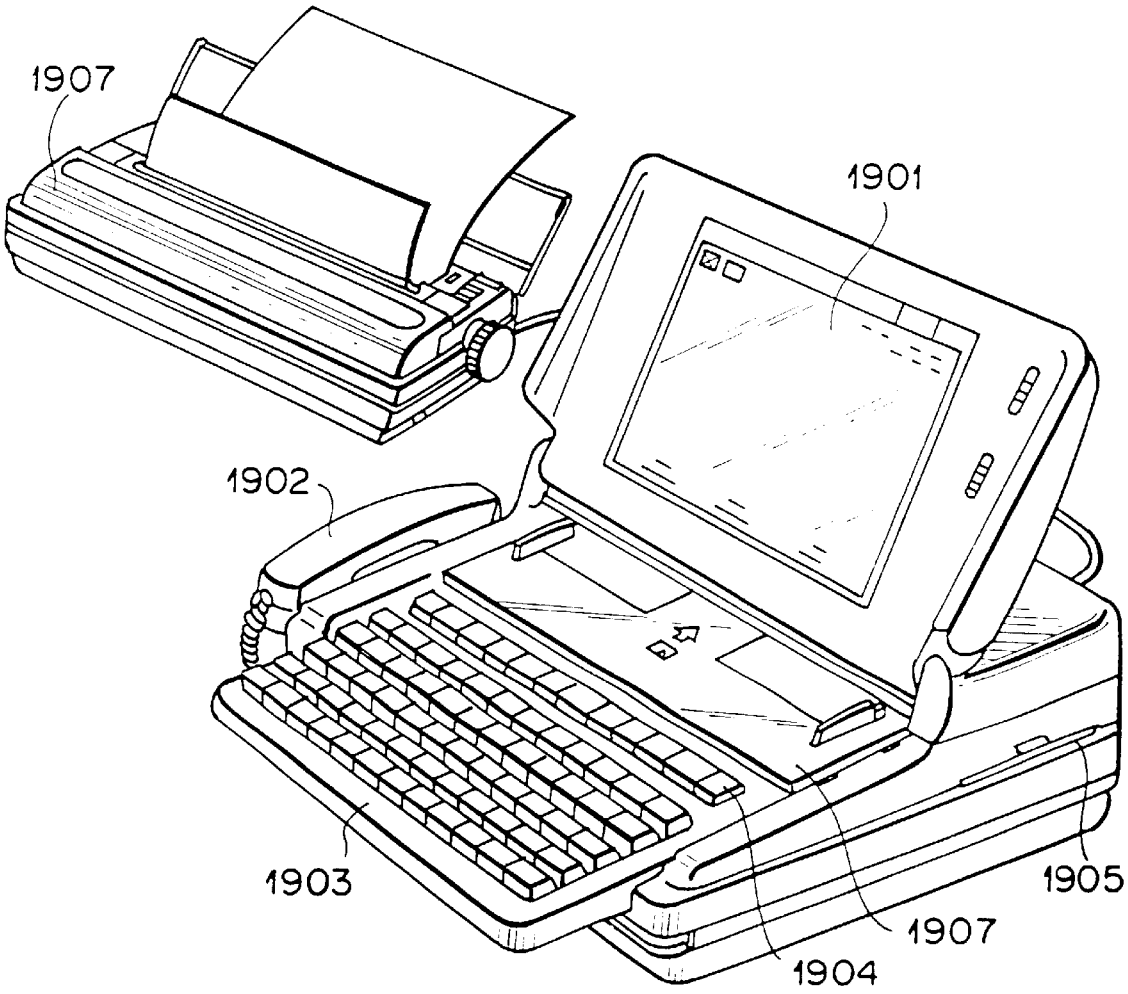
FIG. 26 is a schematic perspective view of an information-processing apparatus using an ink-jet recording printer of the present invention as an output means.

FIG. 26 is a diagrammatic external view of the information processing system shown in FIG. 25.

In FIG. 26, a reference numeral 1901 denotes a flat panel display utilizing a liquid crystal and so forth. On this display, the touch panel 1803 is overlaid so that coordinate position input or item designation input can be performed by depressing the surface of the touch panel 1803 by a finger or so forth. A reference numeral 1902 denotes a handset to be used when a function as the telephone machine of the apparatus is used. A keyboard is detachably connected to a main body of the apparatus through a cable and adapted to permit entry of various document information or various data input. On the other hand, on the keyboard 1903, various function keys and so forth are arranged. A reference numeral 1905 denotes an insertion mouth of the external storage device 1812 for accommodating a floppy disk inserted thereinto.

A reference numeral 1906 denotes a paper stacking portion for stacking the original to be read by the image reader portion 1807. The original read by the image reader portion is discharged from the back portion of the apparatus. On the other hand, in facsimile reception, the received information is printed by the ink-jet printer 1907.

It should be noted that while the display portion 1802 may be a CRT, it is desirable to employ a flat display panel, such as a liquid crystal display employing a ferrodielectric liquid crystal for capability of down-sizing and reduction of thickness as well as reduction of weight.

When the information processing apparatus as set forth apparatus is operated as the personal computer or the wordprocessor, various information input through the keyboard portion 1811 is processed according to a predetermined program by the control portion 1801 and output as printed image by the printer portion 1806.

When the information processing apparatus is operated as a receiver of the facsimile machine, facsimile information input from the FAX transmission and reception portion 1808 via a communication network is subject reception process according to the predetermined program and output as received image by the printer portion 1808.

In addition, when the information processing apparatus is operated as a copy machine, the original is read by the image reader portion 1807 and the read original data is output to the printer portion as copy image via the control portion 1801. It should be noted that, when the information processing apparatus is used as the transmitter of the facsimile machine, the original data read by the image reader 1807 is processed for transmission according to the predetermined program by the control portion, and thereafter transmitted to the communication network via the FAX transmission and reception portion 1808.

Figure 27:
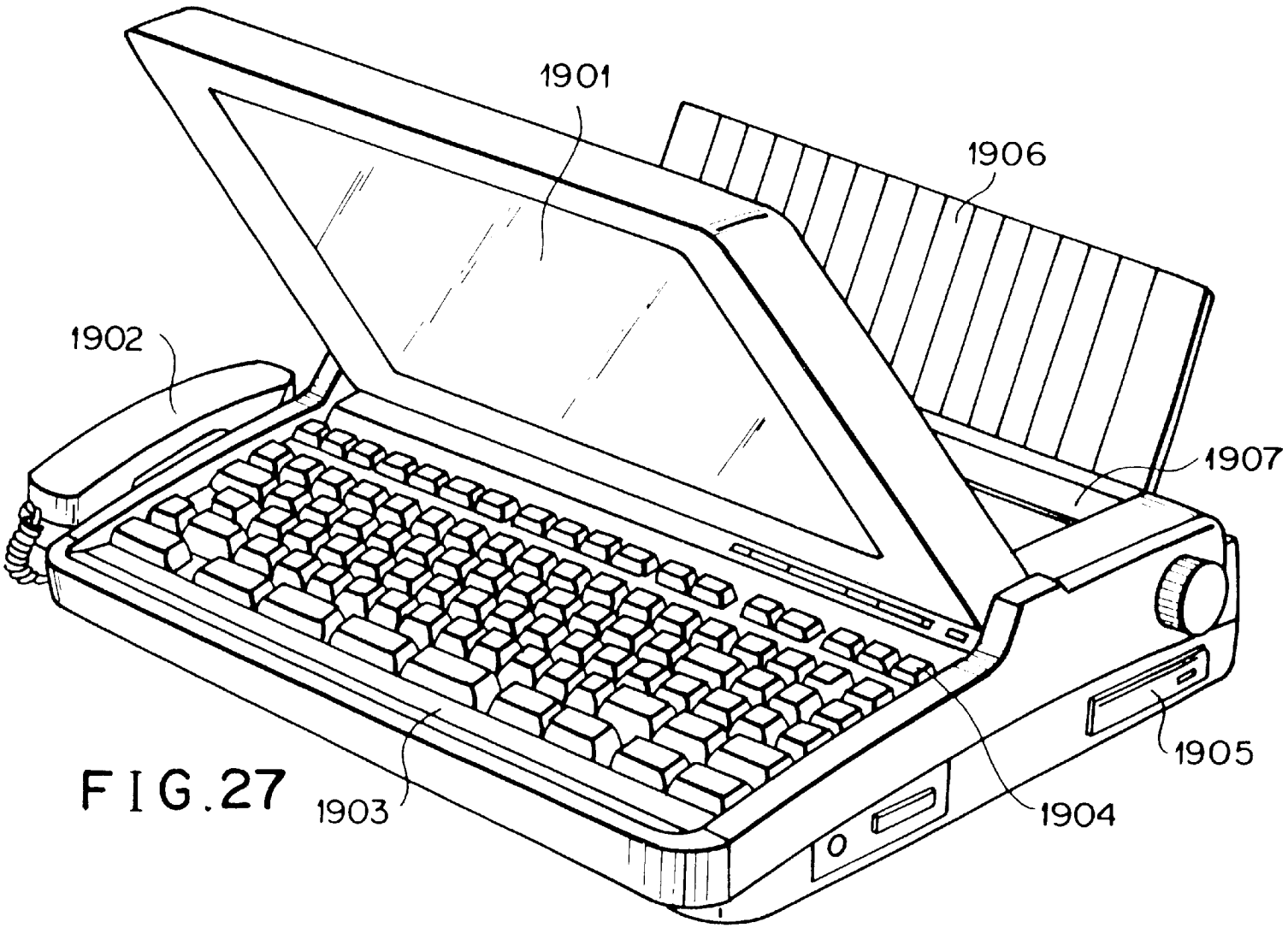
FIG. 27 is a schematic perspective view of an information-processing apparatus using an ink-jet recording printer of the present invention as an output means.

It should be noted that the information processing .apparatus may be an integrated type incorporating the ink-jet printer within a main body as illustrated in FIG. 27. In this case, portability can be further improved. In FIG. 27, the portions having the same function to FIG. 26 are shown with the corresponding reference numerals.

As set forth above, a multi-function type information processing apparatus may obtain high quality printed image at high speed and low noise by employing the printing apparatus of the present invention. Therefore, the functions of the information processing apparatus can be further enhanced.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A method of making application data for applying recording-improvement liquid when an image is recorded on a recording medium by applying a plurality of different color inks and the recording-improvement liquid, said method comprising the steps of:

detecting a boundary portion between different colors in the image based on data with respect to inks used to record the image; and making application data for applying the recording-improvement liquid to at least the boundary portion which is detected in said detecting step, and wherein said recording-improvement liquid includes a chemical compound that performs a chemical reaction in which a coloring material in ink becomes insoluble or coagulates.

2. A method as claimed in claim 1, wherein application of the inks and the recording-improvement liquid is performed by imparting to the inks and the recording-improvement liquid thermal energy for ejecting the inks and the recording-improvement liquid.

3. A method as claimed in claim 1, wherein, in said step of making application data, data is made for applying the recording-improvement liquid to a region adjacent to the boundary portion, the region extending over a predetermined number of dots from the boundary portion.

4. A method as claimed in claim 1, wherein the boundary portion comprises a boundary between a color image and a black image.

5. An apparatus for making application data for applying recording-improvement liquid when an image is recorded on a recording medium by applying a plurality of different color inks and the recording-improvement liquid, said apparatus comprising:

a boundary-portion detector, adapted to detect a boundary portion between different colors in the image based on data with respect to inks used to record the image; and an application data generator, adapted to make application data for applying the recording-improvement liquid to at least the boundary portion which is detected by said boundary-portion detector, and wherein the recording-improvement liquid includes a chemical compound that performs a chemical reaction in which a coloring material in ink becomes insoluble or coagulates.

6. An apparatus as claimed in claim 5, wherein application of the inks and the recording-improvement liquid is performed by imparting to the inks and the recording-improvement liquid thermal energy for ejecting the inks and the recording-improvement liquid.

7. An apparatus as claimed in claim 5, wherein said application data generator makes data for applying the recording-improvement liquid to a region adjacent to the boundary portion, the region extending over a predetermined number of dots from the boundary portion.

8. An apparatus as claimed in claim 5, wherein the boundary portion comprises a boundary between a color image and a black image.

9. A computer-executable program for generating application data for applying recording-improvement liquid when an image is recorded on a recording medium by applying a plurality of different color inks and the recording-improvement liquid, said program comprising code for executing the steps of:

detecting a boundary portion between different colors in the image based on data with respect to inks used to record the image; and making application data for applying the recording-improvement liquid to at least the boundary portion which is detected in said detecting step, wherein the recording-improvement liquid includes a chemical compound that performs a chemical reaction in which a coloring material in ink becomes insoluble or coagulates.

10. A computer program as claimed in claim 9, wherein, in said step of making application data, data is made for applying the recording-improvement liquid to a region adjacent to the boundary portion, the region extending over a predetermined number of dots from the boundary portion.

11. A computer program as claimed in claim 9, wherein the boundary portion comprises a boundary between a color image and a black image.

* * * * *

UNITED STATES PATENT AND TRADEMARK OFFICE

CERTIFICATE OF CORRECTION

PATENT NO. : 6,334,666 B1 
DATED : January 1, 2002
INVENTOR(S) : Toshiharu Inui et al.

It is certified that error appears in the above-identified patent and that said Letters Patent is hereby corrected as shown below:

Drawings,
SHEET 9, FIG. 9, “EXIST” should read -- EXISTS --.

Column 1,
Line 48, “thereon” should read -- thereon, --; and
Line 49, “,a” should read -- a --.

Column 2,
Line 3, “nozzles” should read -- nozzles, --;
Line 14, “on” should read -- of --;
Line 52, “kind of the” should be deleted;
Line 54, “its” should read -- it is a --; and “require” should read -- requires --; and
Line 63, “includes” should read -- including --.

Column 3,
Line 3, “is” (first occurrence) should read -- is, --.

Column 6,
Line 9, “a-full-color” should read -- a full-color --.

Column 7,
Line 35, “ink-et” should read -- ink-jet --.

Column 8,
Line 59, “a” (second occurrence) should read -- an --.

Column 9,
Line 25, “there” should read -- there are --; and
Line 59, “on-which” should read -- on which --.

Column 10,
Line 50, “follows.” should read -- following. --;
Line 61, “ingredients.” should read -- ingredients: --; and
Line 64, “LTD.)” should read -- Ltd.) --.

Column 11,
Line 4, “LTD.)” should read -- Ltd.) --;
Line 11, “LTD.)" should read -- Ltd.) --;
Line 24, “LTD)” should read -- Ltd.) --; and
Line 34, “LTD.)” should read -- Ltd.) --;.

UNITED STATES PATENT AND TRADEMARK OFFICE

CERTIFICATE OF CORRECTION

PATENT NO. : 6,334,666 B1
DATED : January 1, 2002
INVENTOR(S) : Toshiharu Inui et al.

It is certified that error appears in the above-identified patent and that said Letters Patent is hereby corrected as shown below:

Column 12,
Line 22, “an effects” should read -- any effects --.

Column 17,
Line 36, “the way of the follows” should read -- the following way --.

Column 18,
Line 26, “LTD)” should read -- Ltd.) --; and
Line 33, “100 nm” should read -- 100 nm results. --.

Column 19,
Line 4, “LTD.)” should read -- Ltd.) --;
Line 30, “LTD.)” should read -- Ltd.) --; and
Line 57, “LTD.)” should read -- Ltd.) --.

Column 20,
Line 20, “embodiment” should read -- embodiments --;
Line 64, “be” should be deleted; and
Line 65, “occurred” should read -- occur --.

Column 21,
Line 17, “heads” should read -- head --; and
Line 25, “at a,” should read -- at a --.

Column 24,
Line 57, “alcdhol” should read -- alcohol --.

Column 25,
Line 58, “of” should be deleted; and
Line 65, “eject” should read -- ejecting --.

UNITED STATES PATENT AND TRADEMARK OFFICE

CERTIFICATE OF CORRECTION

PATENT NO. : 6,334,666 B1
DATED : January 1, 2002
INVENTOR(S) : Toshiharu Inui et al.

It is certified that error appears in the above-identified patent and that said Letters Patent is hereby corrected as shown below:

Column 27,
Line 12, “Secondary” should read -- Secondarily --; and
Line 37, “In stead” should read -- Instead --.

Column 28,
Line 30, “in stead” should read -- instead --.

Column 29,
Line 24, “LTD.)” should read -- Ltd.) --;
Line 29, “LTD.)” should read -- Ltd.) --;
Line 36, “LTD.)” should read -- Ltd.) --;
Line 37, “thiodigiycol” should read -- thiodiglycol --;
Line 48, “LTD)” should read -- Ltd.) --; and
Line 57, “LTD.)” should read -- Ltd.) --.

Column 30,
Line 16, “is occurred” should read -- occurs --;
Line 17, “results” should read -- it results --;
Line 18, “means” should read -- means of --;
Line 24, “to” (first occurrence) should read -- too --; and
Line 46, “effects” should read -- effect --; and “Because they” should read -- They --.

Column 31,
Line 4, “as it are,” should be deleted.

Column 32,
Line 7, “there” should read -- there are --;
Line 35, “tensity” should read -- density --;
Line 37, “tensity” should read -- density --;
Line 48, “resulting” should read -- resulting in --;
Line 49, “tensity” should read -- density --;
Line 58, “result” should read -- resulting --; and
Line 67, “be occurred” should read -- occur --.

UNITED STATES PATENT AND TRADEMARK OFFICE

CERTIFICATE OF CORRECTION

PATENT NO. : 6,334,666 B1
DATED : January 1, 2002
INVENTOR(S) : Toshiharu Inui et al.

It is certified that error appears in the above-identified patent and that said Letters Patent is hereby corrected as shown below:

Column 33,
Line 3, “be occurred” should read -- occur --;
Line 11, “with out” should read -- without --;
Line 21, “breeding” should read -- bleeding --;
Line 23, “enoughly” should read -- adequately --;
Line 29, “mount” should read -- amount --;
Line 38, “breeding” should read -- bleeding --;
Line 43, “in” should be deleted;
Line 45, “breading” should read -- bleeding --; and
Line 65, “an” should read -- a --.

Column 34,
Line 2, “a” should read -- and a --;
Line 14, “reliquid” should read -- reliquification --; and
Line 17, “a” should read -- an --.

Column 36,
Line 27, “read” should read -- reading --; and
Line 30, “document,” should read -- documents, --.

Signed and Sealed this

Second Day of July, 2002

*Attest:*

*Attesting Officer*

JAMES E. ROGAN
*Director of the United States Patent and Trademark Office*

UNITED STATES PATENT AND TRADEMARK OFFICE
Certificate

Patent No. 6,334,666 B1 Patented: January 1, 2002

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Toshiharu Inui, Yokohama, (JP); Hiromitsu Hirabayashi, Yokohama, (JP); Jiro Moriyama, Kawasaki, (JP); Hiroshi Tajika, Yokohama, (JP); Yutaka Kurabaya, Tokorozawa, (JP); Hitoshi Sugimoto, Yokohama, (JP); Kiichiro Takahashi, Kawasaki, (JP); Fumihiro Gotoh, Kawasaki, (JP); Masao Kato, Yokohama, (JP); and Minako Kato, Yokohama, (JP).

Signed and Sealed this Fifteenth Day of August 2006.

VIP PATEL
*Supervisory Patent Examiner*
Art Unit 2861